US008615883B2

(12) United States Patent
Lenhardt

(10) Patent No.: US 8,615,883 B2
(45) Date of Patent: Dec. 31, 2013

(54) METHOD FOR PRODUCING A CORNER OF A FRAME-SHAPED SPACER FOR INSULATING GLASS PANES AND SPACER AND INSULATING GLASS PANES PRODUCED ACCORDING THE METHOD

(75) Inventor: Karl Lenhardt, Bad Liebenzell (DE)

(73) Assignee: Plus Inventia AG, St. Gallen (CH)

( * ) Notice: Subject to any disclaimer, the term of this patent is extended or adjusted under 35 U.S.C. 154(b) by 432 days.

(21) Appl. No.: 12/937,171

(22) PCT Filed: Apr. 9, 2009

(86) PCT No.: PCT/EP2009/002649

§ 371 (c)(1),
(2), (4) Date: Oct. 8, 2010

(87) PCT Pub. No.: WO2009/124770

PCT Pub. Date: Oct. 15, 2009

(65) Prior Publication Data

US 2011/0027606 A1 Feb. 3, 2011

(30) Foreign Application Priority Data

Apr. 11, 2008 (DE) ..... 10 2008 019 800
Jul. 16, 2008 (DE) ..... 10 2008 034 024
Feb. 18, 2009 (EP) ..... PCT/EP2009/001155

(51) Int. Cl.
*B21D 7/04* (2006.01)
*B21D 21/00* (2006.01)
*B21K 23/00* (2006.01)
*E06B 3/00* (2006.01)

(52) U.S. Cl.
USPC ..... 29/897.312; 29/469.5; 29/527.2; 29/527.4; 72/369; 156/107; 428/34

(58) Field of Classification Search
USPC ..... 29/469.5, 527.2, 527.4, 897.312; 52/204.591; 72/177, 181, 369, 379.2; 156/107; 428/34, 586
See application file for complete search history.

(56) References Cited

U.S. PATENT DOCUMENTS 2,219,595 A * 10/1940 Lang ..... 228/142
3,649,398 A * 3/1972 Keith ..... 156/79
3,911,554 A * 10/1975 Ford ..... 29/527.2
4,597,279 A * 7/1986 Lisec ..... 72/306
4,945,619 A * 8/1990 Bayer ..... 29/33 R
5,640,828 A * 6/1997 Reeves et al. ..... 52/786.13
5,761,946 A * 6/1998 Misera et al. ..... 72/181
6,223,414 B1 * 5/2001 Hodek et al. ..... 29/527.1
6,354,052 B1 * 3/2002 Guinet ..... 52/782.1
6,405,498 B1 * 6/2002 Riegelman ..... 52/204.595
6,470,561 B1 10/2002 Misera et al.

(Continued)

FOREIGN PATENT DOCUMENTS

DE 82 18 332 U1 12/1982
EP 0 947 659 A2 3/1999

(Continued)

*Primary Examiner* — Alexander P Taousakis
(74) *Attorney, Agent, or Firm* — Hackler Daghighian & Martino

(57) ABSTRACT

The invention relates to a method for producing a corner of a frame-type spacer for insulating glass panels by (a) making a metal hollow profile rod available, which rod has an outer wall, two parallel flanks, and an inner wall, (b) indenting the inner wall and the two flanks in the position of the hollow profile rod where the corner is supposed to be formed, and (c) bending the hollow profile rod by a defined angle.

42 Claims, 19 Drawing Sheets

(56) References Cited

U.S. PATENT DOCUMENTS

| | | | | |
|---|---|---|---|---|
| 7,021,110 | B2 * | 4/2006 | Rosskamp | 72/326 |
| 7,448,246 | B2 * | 11/2008 | Briese et al. | 72/335 |
| 7,493,739 | B2 | 2/2009 | Baratuci et al. | |
| 2003/0150177 | A1 | 8/2003 | Baratuci et al. | |
| 2006/0150577 | A1 * | 7/2006 | Hodek et al. | 52/786.13 |
| 2008/0263973 | A1 | 10/2008 | Lenhardt | |

FOREIGN PATENT DOCUMENTS

| | | | |
|---|---|---|---|
| EP | 1 030 024 | A2 | 2/2000 |
| EP | 1 281 451 | A2 | 8/2001 |
| WO | WO 02/071904 | A | 9/2002 |

* cited by examiner

METHOD FOR PRODUCING A CORNER OF A FRAME-SHAPED SPACER FOR INSULATING GLASS PANES AND SPACER AND INSULATING GLASS PANES PRODUCED ACCORDING THE METHOD

BACKGROUND OF THE INVENTION

Spacers for insulating glass panes generally comprise hollow profile rods that are made of aluminum or stainless steel containing a pourable desiccant, typically molecular sieves. The aim of the desiccant is to bind moisture present in the insulating glass pane, so that the dew point is always met in the insulating glass pane at the temperatures that occur. Metallic spacers are today generally bent in one piece from a hollow profile rod, into which the desiccant has already been filled. Prior to bending a corner, the inside wall is notched, so that the corner forms precisely at the intended site and has a defined appearance. The inside wall shall be understood as the wall of the spacer facing the inside of the insulating glass pane. The all of the hollow profile rod located opposite of the inside wall is referred to as the outside wall or base. The two walls connecting the inside wall and outside wall to each other and facing the individual glass plates inside the insulating glass pane are referred to as the flanks; they typically run predominantly parallel to each other because they have to be glued to the glass plates. At the flanks, during bending the hollow profile rod tends to arch outward and/or form outwardly protruding pleats. In an effort to prevent this, the hollow profile rods are clamped at the flanks between jaws, which force the hollow profile rods not to widen in a corner during bending, see EP 1 281 451 A1.

After bending, the two mutually opposing ends of the hollow profile rod are joined by way of a connector and a closed frame is formed thereby. The hollow profile rods to be bent are generally connected consecutively to each other by straight connectors. The spacers may therefore also comprise a plurality of straight connectors. Such frame-shaped metallic spacers are characterized by good mechanical stability. However, they have the disadvantage that the production thereof is complex.

Furthermore, spacer frames are known that are made of metallic U-profiles, thermoplastic solid profiles, which are extruded directly onto a glass plate, and plastic hollow profiles, which like the spacers made of metallic hollow profile rods can be filled with a granular, pourable desiccant.

Spacers made of plastic hollow profiles have only low thermal conductivity, so that they impair the heat transfer between the individual glass plates of the insulating glass pane in the desirable manner. The disadvantage, however, is that hollow profile rods made of plastic cannot be bent to form squared frames, when they have the hardness and strength required for the use as spacers in insulating glass panes. This applies in particular to hollow profile rods made of glass fiber reinforced plastic. One might consider to form spacer frames from plastic hollow profiles in that straight hollow profile sections, which form the sides of the frame-shaped spacers, are connected to each other by inserting angle pieces made of metal into the corners of the hollow profile sections, where they engage with barbs. This technology known from earlier times for the production of metallic spacers, however, is labor-intensive and results in spacer frames which as a result of a lack of rigidity are overall unstable in the corner region and cannot be easily handled and glued to a glass plate with the necessary precision. In addition, spacer frames comprising such inserted corners are unfavorable in light of the fact that insulating glass panes must be hermetically sealed at the edge thereof to prevent the penetration of moisture.

It is furthermore known to form spacers from metallic hollow rod profiles by connecting individual hollow profile rods at the corners of the spacers by angle pieces, which have two sides that are connected by a hinge and can be latched to each other in a position in which the sides include a right angle with each other. For this purpose, the individual hollow profile rods are first connected to each other in a straight line, provided at the flanks thereof continuously with an adhesive sealant, and then formed into a frame by pivoting the hollow profile rods about the hinge of the respective angle piece, said frame being close by a linear connector that is inserted in the corners of the hollow profile rod. Such a configuration of the corners results in unstable spacers having the disadvantages described above.

In order to produce spacers from plastic hollow profile rods in one piece, it is already known from EP 0 947 659 A2 and EP 1 030 024 A2 to disengage the hollow profile rods at the sites where corners are to be formed by producing V-shaped notches, the tips of which extend to the wall of the hollow profile strip located on the outside in the finished spacer. So as to shape a frame, only the outside wall of the hollow profile rod is bent at the disengaged sites thereof. While in this way spacers are obtained, which also have a closed outside wall at the corners, the frame is an unstable structure and requires stabilization because the sides of the spacer at the corners only adhere to each other by the outside wall thereof. For this purpose, it is known from EP 0 947 659 A2 and EP 1 030 024 A2 to mold a thermoplastic resin in the corner regions of the spacer frame through an open in one of the flanks thereof, wherein the resin bridges the corners and lends the spacer the necessary stability after the plastic has cooled and cured. The disadvantage is that it takes comparatively long until the plastic has cooled off and solidified. In order to shorten the time, it is known from EP 1 030 024 A2 to transfer the spacer during production, after injecting the plastic, in a special curing zone, while maintaining the angle of the bent corner. This method is time-intensive and costly.

In contrast, significant progress was provided by WO 2006/077096 A1, which discloses a spacer for insulating glass panes which is produced from a hollow profile rod made of plastic by providing it at the sites intended for the corners with a recess, which opens the inside wall and the two flanks of the hollow profile wall, but leaves the outside wall intact. In order to stabilize the corners, angle pieces are used, which have two sides connected by a hinge and can be transferred from a rectilinear shape into an angled shape, in which they can be fixed relative to each other. Such an angle piece is initially positioned in a rectilinear fashion in the region of the respective corner that is to be formed. The corner is then formed by bending the hollow profile rod and it is stabilized by the sides of the angle piece that latch to each other in the specified angular position. It is furthermore known from WO 2006/007096 A1 to apply an adhesive sealant and a desiccant-containing compound to the hollow profile rod, which is still in the rectilinear state and in which the angular pieces, which are still in the rectilinear state, have already been inserted, then to form the corners in the hollow profile rod, and to glue the corners of the hollow profile rod to each other.

SUMMARY OF THE INVENTION

It is the object of the present invention to provide a possibility for producing a frame-shaped spacer having bent corners for insulating glass pane from metallic hollow profile rods with lower complexity than in the past.

This object is achieved by a method having the characteristics of claim 1. A frame-shaped spacer that is produced according to this method is the subject matter of claim 57. An insulating glass pane comprising such a spacer is the subject matter of claim 60. Advantageous refinements of the invention are the subject matter of the dependent claims.

The invention has considerable advantages:

Because the two flanks of the hollow profile rod, preferably also the inside wall thereof, are impressed at the site of the hollow profile rod that is intended for forming the respective corner before the rod is bent, it can be ensured without further measures that the inside wall of the hollow profile rod takes on a defined, reproducible course in the region of the corner, and also that during bending the two flanks of the hollow profile rod are not pushed outward and/or form pleats which widen the spacer in the region of a corner. Excess material of the flanks is rather pushed into the hollow space of the hollow profile rod, so that the width of the hollow profile rod does not exceed the original width of the hollow profile rod even in the region of the corners. This is important, because if this were not the case, pressure peaks would develop during the pressing operation of the insulating glass panes in the region of the corners, resulting in breakage of the glass.

Jaws, which previously were required when bending metallic hollow profile rods into spacers for insulating glass panes in order to prevent the hollow profile rods from widening in the region of the corners, are no longer required according to the invention.

With the method according to the invention, bending the corners and closing the spacer can be carried out manually. The apparatus-related expenditure, which was previously required for the production of metallic spacers for insulating glass panes, can be considerably reduced.

Compared to spacers made of plastic, as those which are disclosed in WO 2006/077096 A1, which can also be bent and closed manually, one advantage is that no corner angles are required to stabilize the corners, and additionally it is much easier to work the subsequent corner regions of the hollow profile rod required prior to bending: No complicated cut-outs must be produced, no waste must be removed, and no expensive tools are required. Rather, all that is required is to impress the hollow profile rod at the intended sites.

Since the hollow profile rod does not have to be notched in the region of the corners, but only pressed in, and therefore a continuous hollow profile also exists in the corner region, the corners are sufficiently stable for the installation in an insulating glass pane, even without special stabilizing measures.

Since the hollow profile is continuously preserved, even in the corner region of the spacer, the spacer can form a double barrier and therefore offer double the safety against the penetration of moisture in the insulating glass pane.

If, in individual cases, a crack should form in the hollow profile rod by impressing an area, it does not impair the installation thereof in an insulating glass pane, because the outside wall of the spacer, which is particularly important for sealing the inside space of the insulating glass pane, generally does not run any risk of tearing during the bending operation.

Even if the flanks of the hollow profile rod fold in under the action of the forces, the insulating glass pane can be flawlessly sealed even in the critical corner region of the spacer by applying a sealant to the flanks. Suitable sealants include those which are already known for bonding and sealing insulating glass panes.

In principle, the hollow profile rod may comprise a desiccant when it is being bent. In this case, care should be taken that the corner region of the hollow profile rod contains less desiccant during bending than is present outside of the corner region. It is beneficial that the contour of the walls of the hollow profile rod resulting from the hollow profile rod being impressed, and the bending operation as such, push desiccant out of the corner region, thereby facilitating the bending operation. The hollow profile rod, however, is preferably impressed and bent in the empty state, and preferably desiccant is also not added into the hollow profile rod subsequently. This has the advantage that the production of the hollow profile rod can be simplified. However, if the hollow profile rod contains a desiccant, it must have a connection to the air space in the insulating glass pane when the insulating glass pane is assembled; for this purpose, the inside wall of the hollow profile rod must be perforated. However, if the hollow profile rod is not filled with a desiccant, the hollow profile rod does not require any perforation whatsoever, but can be produced inexpensively by a simple extrusion press operation. This is particularly suitable for hollow profile rods made of aluminum. As an alternative, the hollow profile rod can be shaped from a non-perforated metal strip by roll forming; in this case, it has a longitudinal seam, which advantageously is secured by welding, in particular by laser welding. The production method by roll forming is particularly suitable for hollow profile rods made of stainless steel. The longitudinal seam is preferably sealed by welding. The longitudinal seam can also be closed by gluing.

It is preferable for the hollow profile rod not to have any opening in any of the walls thereof. This increases the safety against the penetration of moisture into the inside of the insulating glass pane, because the walls of the metallic hollow profile rod produced without openings are diffusion-proof to water vapor. In order to seal the insulating glass pane, only the gaps between the flanks of the hollow profile rod and the two glass slabs of the insulating glass pane must be sealed using an adhesive compound, which is the state of the art. Because the flanks of the hollow profile rod are not pushed outward during bending in the corner region when applying the method according to the invention, but excess material is pushed inward, the corner region that is particularly critical for sealing an insulating glass pane can be provided with a sufficient quantity of adhesive sealant, intermeshed with the pleats developing in the corner region and the diffusion path can thus be extended.

The adhesive sealant to be applied to the flanks is thermoplastic polyisobutylene, for example, and is intended to prevent moisture from diffusing through the gap between the spacer and glass plate sealed by the sealant into the interior space of the insulating glass pane. Such a thermoplastic sealant is also referred to as the primary sealing compound. It is preferably applied after impressing, but before bending the hollow profile rod, more specifically substantially over the entire length of the hollow profile rod, including the impressed sites of the flanks of the hollow profile rod. This has the advantage that, when bending the respective corner, the sealant is not carried along by the inwardly folding section of the flank and tightly pressed in the pleat, so that it can be assured that no hollow spaces develop in the pleat, which are not filled with the sealant. The bending creates an excess of sealant in the corner region of the spacer, said excess further increasing the sealing action during the subsequent pressing operation of the insulating glass pane, in particular in the critical region of the corner, which is particularly advantageous.

When stating here that the adhesive sealant is to be applied substantially over the entire length of the hollow profile rod, it means that initially a small length of the hollow profile rod can remain without the sealant at the ends of the hollow profile rod. After the two ends of the hollow profile rod have been connected by a straight connector, a clearance in the strand of sealant, if necessary, may be closed by subsequently applying sealant.

If the longitudinal seam is located on a flank of the hollow profile rod on a hollow profile rod that has been formed by roll forming, the sealant covers the longitudinal seam and seals any potentially remaining non-tight areas of the longitudinal seam. For this reason, the longitudinal seam is preferably located on a flank of the hollow profile rod.

An adhesive sealant can be applied not only to the flanks of the hollow profile rod, an adhesive compound may also be applied to the inside wall of the hollow profile rod—substantially over the entire length thereof, including the impressed site of the inside wall—specifically advantageously such a compound which contains a desiccant, for example a molecular sieve powder, which is used to bind any moisture potentially present in the insulating glass pane and keep the dew point low. In this case, it may advantageously be foregone to fill a desiccant into the hollow profile rod, so that it requires no perforated inside wall. A further advantage of this measure is that it lends the spacer in the insulating glass pane an appealing appearance. A matte black adhesive compound is less noticeable and less interfering in the insulating glass pane than an uncoated, brightly reflecting metallic surface, as that which is known from spacers made of stainless steel, and notably made of aluminum. In addition, the matte black surface creates a reflex of the color of the window or door frame in which the insulating glass pane is later installed, and therefore adapts well to the appearance thereof. A further considerable advantage is that the corner region of the spacer is given a very appealing appearance by applying the desiccant-containing mass to the inside wall of the hollow profile rod. The fact that the inside wall of the hollow profile rod has been impressed prior to bending the corners is no longer apparent due to the subsequent application of a desiccant-containing compound.

The adhesive sealant and the desiccant-containing compound are preferably applied to the hollow profile rod so that they directly adjoin each other. The hollow profile rod is then continuously coated on three sides, at the flanks and the inside wall thereof, which increases the safety against the diffusion of moisture. The outside wall and the inside wall of the hollow profile rod and the desiccant-containing compound applied to the inside wall each prevent the penetration of water vapor into the insulating glass pane. In the gap between the glass slabs and the flanks of the spacer, the sealant applied there, for example one that is based on polyisobutylene, prevents moisture from penetrating over a relatively long diffusion path. If a small amount of moisture should still diffuse through the adhesive sealant at some point, it can still be absorbed by the desiccant, which is embedded in the compound that adheres to the inside wall of the hollow profile rod and adjoins the sealant applied to the flanks. The desiccant-containing compound used, for example, can be any compound which is known in the production of insulating glass as TPS material, from which spacers are extruded in situ onto a glass pane. Insulating glass panes comprising such a thermoplastic spacer, in which a powdery desiccant has been embedded, are known under the TPS brand. The TPS material is a primary sealing compound based on polyisobutylene, comprising a zeolite powder (molecular sieves) finely dispersed therein as the desiccant.

The sealant applied to the flanks and the compound applied to the inside wall of the hollow profile rod can differ from each other, but they can also be the same. They are preferably applied synchronously in one operation, or with time overlap, to both flanks and the inside wall of the hollow profile rod. When a thermoplastic "primary" sealing compound is used for sealing the gap between the spacer and the two adjoining glass plates, it cannot cause the necessary firm bond between the glass plates and the spacer due to the thermoplastic property thereof. For this, rather a setting "secondary" sealing compound is required, for example a polysulfide (Thiokol), polyurethane, or silicone, to supplement the thermoplastic "primary" sealing compound. In the state of the art, the secondary sealing compound is generally filled into an edge joint of the insulating glass pane, which is delimited by the two glass plates and the outside wall of the spacer offset with respect to the edges thereof.

A particularly advantageous possibility is to apply a setting sealant to the flanks and the inside wall of the hollow profile rod, for example, a reactive hot melt adhesive, in which a powdery desiccant has been embedded. In this way, the insulating glass pane can be sealed and, at the same time, the two glass plates thereof can be mechanically rigidly and permanently connected to the spacer, specifically by the setting process, so that a final sealing process, which would otherwise be required, using a curing mixed adhesive can be dispensed with, which as the "secondary" sealing compound in the prior art typically rigidly connects the spacer to the two glass plates. One example of such a setting sealant, which combines the function of a primary and a secondary sealing compound, is known from WO 2008/005214 A1, the content of which relating to the disclosure of the sealing compound is thereby expressly included by reference.

It is particularly advantageous not to apply the desiccant-containing compound to the inside wall of the spacer profile, but only to the flanks of the spacer profile. For this purpose, the profile of the spacer can be configured narrower in a partial region extending from the inside wall than in a partial region extending from the base of the spacer profile. Such hollow profile rods are used extensively in the production of insulating glass, however contrary to the preferred method of the present invention they are installed in the insulating glass pane such that the narrower partial region is located on the outside, which is to say, the outside wall in the prior art is used as the inside wall of the spacer according to the invention; what is the inside wall of the spacer in the prior art is the outside wall of the spacer according to the invention. Additionally, the hollow profile rods known from the prior art have a perforated inside wall, so that the desiccant accommodated in the hollow profile rod can absorb moisture from the inside space of the insulating glass pane. However, according to the invention it is preferred to arrange the desiccant in an adhesive compound in the hollow profile rod and leave the hollow space of the hollow profile rod empty. A perforated wall of the hollow profile rod is therefore not required by the invention. According to the invention, rather a hollow profile rod that is inexpensive to obtain may be used, which compared to the prior art is even further simplified in that none of the walls connecting the flanks are perforated, whereby the sealing action of the insulating glass pane is improved at the same time.

When using a spacer profile which in a partial region extending from the inside wall is narrower than in a partial region extending from the outside wall, it is particularly advantageous to concentrate the desiccant-containing compound in the narrower region of the spacer profile adjoining the inside wall on the flank thereof, and to provide an adhesive compound containing no desiccant, in particular a primary sealing compound and/or a setting secondary sealing compound, which directly connects or connect to the desiccant-containing adhesive compound, in the subsequent wider region of the spacer profile. The desiccant-containing compound and the adhesive sealant containing no desiccant are preferably applied to the flanks of the hollow profile rod in a common operation. In this case, the invention can advantageously be refined such that the compound containing the desiccant is the same compound that is used as the primary sealing compound. It is also possible to use the desiccant-containing compound as the primary sealing compound if it is sufficiently diffusion-tight, which is the case with the TPS material based on polyisobutylene. Finally, even when the desiccant-containing compound is not disposed on the inside wall of the spacer profile, but on the flanks thereof, these flanks may be exclusively provided with a sealing compound according to WO 2008/005214 A1, which then combines the functions of a primary and secondary sealing compound and additionally contains a desiccant. This variant of the invention is characterized in that it requires a minimal amount of sealing compound and minimal machine complexity. Surprisingly it has been found that even with such a small amount of sealing compound between the flanks of the spacer and the glass plates, which additionally contains a powdery desiccant, good sealing action of the insulating glass pane and flawless cohesion of the insulating glass pane can be achieved.

Preferably any sealing compound, this being the desiccant-containing compound, the primary sealing compound if it is different from the compound containing the desiccant, and the secondary sealing compound which cures and establishes the lasting bond between the spacer and the glass plates, is applied exclusively to the flanks of the hollow profile rod.

This enables insulating glass panes which not only have an appealing appearance, but also require a minimal amount of expensive sealing compounds. Preferably a thermoplastic sealing compound, which contains the desiccant and at the same time fulfills the function of a primary sealing compound, is applied to the flanks, and immediately thereafter a setting sealing compound is applied, which fulfills the function of a secondary sealing compound. For such a refinement of the invention, for the spacer preferably a hollow profile rod is used, in which not only the inside wall, but also the outside wall is narrower than the hollow profile rod, so that the flanks thereof have a central partial region, which runs parallel to the surface of the opposing glass plates, and on either side adjoining this central partial region they have a partial region that is set back and ends at the inside wall or the outside wall of the hollow profile rod, which are narrower than the hollow profile rod overall, which has the largest width thereof between the central partial regions of the flanks.

A spacer having such a profile can be used with particular versatility for purpose of the invention. The recessed partial region adjoining the inside wall can be provided with a sufficient quantity of the desiccant-containing adhesive compound, which contains sufficient desiccant in order to prevent the insulating glass pane from fogging on the inside over the planned service life of more than 20 years, preferably of more than 25 years.

A thin layer of a primary sealing compound may be applied to the central partial region of the flanks, wherein the compound contains no desiccant and reliably prevents both the diffusion of water vapor from the outside and a loss of gas which is different from air and may be added to fill the insulating glass pane. The recessed partial region of the flanks adjoining the outside wall may be provided with a secondary sealing compound, which sets and establishes the permanent mechanical bond between the glass plates and the spacer. However, it is also possible to use a primary sealing compound, in particularly one based on polyisobutylene, in which the desiccant has been embedded in powder form, as the basis for the desiccant-containing sealing compound. Instead of the sealing compound containing no desiccant, the same secondary sealing compound can be applied to the central partial region of the flanks which is also provided in the recessed region of the flanks adjoining the outside wall.

However, it is also possible to provide all three sections of the flanks with a uniform sealing compound, which fulfills both the function of a primary sealing compound and the function of a secondary sealing compound and contains a desiccant.

The recessed regions of the flanks not only make it possible to accommodate sufficient quantities of primary and/or secondary sealing compounds, but also have the advantage that the deflections of the individual glass plates due to wind loads, temperature loads, and fluctuations of the ambient pressure do not result in hairline cracks in the sealing compounds, which would cause leaks in the insulating glass pane. During such deflection movements, the narrow central partial regions of the flanks constitute a fixed point for the deflection movements, which pull the strongest in the vicinity of the inside wall and in the vicinity of the outside wall at the particular sealing compound provided there, but do not cause the formation of cracks in the sealing compound because the thickness of the compound there is so high that the ultimate tensile strength thereof is not exceeded.

The recessed partial regions of the flanks adjoining the central partial region of the flanks may be configured in a stepped manner with sharp edges, but preferably have a concave cross-section, with a preferably rounded contour, which favors complete filling of the interstices between the flanks of the spacer and the adjoining glass panes comprising the sealing compound.

In the cross-section, the contour of the recessed partial regions of the flanks adjoining the respective central partial region of the flanks preferably is such that the spacer profile tapers starting from the central region toward the outside wall of the spacer profile and toward the inside wall of the spacer profile, or initially tapers and transitions into a constant tapered region, in which the flanks run parallel to the central partial regions of the flanks. It should be noted that the inside wall of the spacer shall be understood to mean the wall of the spacer facing the inner space of the insulating glass pane, and the outside wall to mean the wall of the spacer located opposite of the inside wall. The recessed partial regions adjoining thereon are assigned to the flanks.

It is also possible to select the contour of the recessed partial regions of the flanks adjoining the respective central partial region of the flanks such that the spacer profile, starting from the central partial region, initially tapers and then widens again when approaching the outside wall and/or the inside wall of the spacer profile, thereby creating an undercut at the flanks. Such an embodiment, however, is not preferred because it may make sealing the insulating glass pane more difficult.

Preferably, a hollow profile rod is used which has a non-symmetrical configuration with respect to the longitudinal center plane intersecting the flanks, so that the recesses adjoining the inside wall are different from the recesses adjoining the outside wall and can accommodate differing quantities of sealing compounds. This has the advantage that one and the same hollow profile rod can be used to produce spacers in which the larger recesses are either provided to adjoin the inside wall or the outside wall of the spacer. The insulating glass manufacturer can select any embodiment that appears the most suitable for the specific contract. If primarily a large volume of the desiccant-containing compound is important, he will orient the spacer profile in the spacer such that the larger interstices between the glass plates and the flanks face the inside space of the insulating glass pane. However, if a larger volume of the secondary sealing compound is important, he will orient the spacer profile such that the larger interstices between the glass plates and the flanks of the spacer face outward.

With respect to the longitudinal center plane intersecting the outside wall and inside wall, however, the hollow rod profile used for producing the spacer is advantageously configured mirror-symmetrically.

The impression according to the invention of the inside wall and the flanks of the hollow profile rod can be carried out in different ways. Preferably, the hollow profile rod is impressed using a chisel having a rectilinear leading edge, which during the impression process runs at a right angle to the longitudinal direction of the hollow profile rod. Advantageously, three separate chisels are used for impressing the inside wall and the two flanks. The chisels are preferably moved at a right angle to the longitudinal direction of the hollow profile rod when impressing the hollow profile rod. This causes symmetrical indentations to form, which is particularly advantageous for the bending process.

The chisels are only to impress the hollow rod profile. If possible, no cracks should develop. The leading edge of the chisel is therefore preferably not configured as a bezel, but slightly rounded, preferably with a radius of 0.1 mm to 0.3 mm. This assures good results, in particular for impressing the flanks. For impressing the inside wall, it is also possible to use chisels having a larger radius at the effective leading edge thereof.

For hollow profile rods, the outside wall of which is not narrower than the hollow profile rod as a whole, the following applies:

To ensure that the flanks fold inward in a defined manner when bending the edges, they should preferably be impressed at the full height of the profile of the hollow profile rod. However, the hollow profile rod does not have to be impressed at the edge between the outside wall and the flanks. It is best if the penetration depth of the chisel increases from the outside wall to the inside wall when impressing the flanks. At the outside wall, the flanks are preferably impressed 1.5 mm to 2 mm deep. It has been shown that such an impression of the flanks at the outside wall recedes again when bending a corner, which is particularly advantageous for achieving a diffusion-tight corner in the insulating glass pane.

The flanks may be impressed more strongly at the inside wall of the hollow profile rod, for example 2 mm to 4 mm deep.

The inside wall of the hollow profile rod is preferably impressed more strongly than the flanks, preferably by two thirds to three quarters of the height of the hollow profile rod measured from the outside of the outside wall to the outside of the inside wall. This is beneficial for creating a reproducible contour of the inside wall of the corner after the bending operation.

The following applies to a hollow profile rod, in which also the outside wall is narrower than the hollow profile rod as a while, which is to say in which the flanks adjoining the outside wall have a recessed partial region:

In this case, the flanks should not be impressed so deep that also the edges of the outside wall are impressed. However, the flanks should be impressed up to the recessed partial region adjoining the outside wall, with the depth of the impression again preferably increasing as the inside wall of the hollow profile rod is approached. During impression of the flanks, the edges of the inside wall are preferably impressed as well.

The two flanks are preferably impressed simultaneously, which is not only efficient, but also favors a symmetrical result.

The flanks are advantageously not impressed simultaneously with the inside wall of the hollow profile rod. Whether it is better to impress the inside wall first and then the flanks, or the flanks first and then the inside wall, will depend on whether the hollow profile rods are to be processed further. In cases in which the inside wall of the hollow profile rod is not to be coated with a desiccant-containing compound, it is preferred to first impress the two flanks in a wedge shape and then impress the inside wall of the hollow profile rod in a wedge shape, in particular in the shape of an acute-angled wedge. After bending, the impressed section is located folded inward in the corner of the hollow profile rod and largely excluded from view.

If the inside wall of the hollow profile rod is to be covered by a desiccant-containing compound after impressing, it is preferred to impress the inside wall of the hollow profile rod using a blunt tool and then impress the flanks using an acute-angled, wedge-shaped chisel. The indentation of the inside wall created with the blunt tool is more advantageous in this case, because during bending of the corner a higher-volume pleat in the inside wall is created, which allows a desiccant-containing compound applied to the indentation of the inside wall to disappear in the corner region, so that no visible accumulation of this compound is created there. The wedge-shaped impressing of the flanks ensures that they fold inward and the corner is created precisely at the predetermined site.

The blunt tool, which is used to impress the inside wall of the hollow profile rod, preferably has a convex front, such as a spherical cap-shaped front. A tool having a blunt or convex front, which has an elongated design in the top view, so that an elongated indentation of the inside wall can be generated, also supplies good results, wherein the longitudinal extension of the indentation should agree with the longitudinal direction of the hollow profile rod. In this way, a shallow depression can be generated in the inside wall, which is beneficial for the visual appearance. However, it is also possible to impress the inside wall of the hollow profile rod using a tool that has a planar front or a wedge-shaped front, the wedge surfaces of which include an obtuse angle with each other.

If the inside wall of the hollow profile rod is impressed using a dull tool, this is preferably done prior to impressing the flanks, which are preferably impressed using acute-angled chisels. After impressing the flanks, the impressed site of the hollow profile rod can advantageously be reshaped using a chisel, which has a concavely extending leading edge and is applied in the direction from the inside wall to the outside wall of the hollow profile rod. The concave leading edge can have an arched course, but a wedge-shaped course is also possible.

In order to implement the invention, the straight hollow profile rod is initially impressed at all sites intended for this purpose, where an edge is to be formed. Then, the adhesive sealant is applied to both flanks of the hollow profile rod. If the adhesive sealant which is applied to the flanks is not a desiccant-containing compound, a desiccant-containing compound can additionally be applied to the flanks and/or the inside wall of the hollow profile rod, preferably however only to the flanks. This is preferably carried out in a single operation by way of coextrusion, or with time overlap; the desiccant-containing compound preferably connects directly and completely to the adhesive sealant not containing any desiccant. Thereafter, the edges are bent, which can be done by machines, in the most cost-efficient manner, but is also possible to do manually, because the position and the shape of the corners are already predetermined by the prior impression of the hollow profile rod. Bending can be done particularly easily when no adhesive compound whatsoever is present on the inside wall and on the outside wall of the hollow profile rod, but only on the flanks. The hollow profile rod can then be gripped without difficulty at the inside wall and outside wall thereof, without coming in contact with the compound applied to the flanks, and can then be bent manually or mechanically. Such a procedure can save several machines, which were previously required for producing spacer frames for insulating glass panes, these being a machine for filling hollow profile rods with a desiccant, a machine for bending filled hollow profile rods, and a machine for coating a finished bent spacer frame, for which purpose the frame has to be repeatedly rotated and moved between a nozzle pair, see DE 34 34 545 C1, for example. Coating a straight hollow rod profile prior to bending it into a spacer frame is considerably easier than coating a frame formed by a hollow profile rod. The invention therefore enables a particularly efficient production of coated spacer frames. A secondary sealing compound is preferably also applied to the flanks of the hollow profile rod before the frame is bent, or a uniform sealing compound is applied, which fulfills the functions of the primary and secondary sealing compounds at the same time and preferably also contains the desiccant. In this way, even the sealing machine for the secondary sealing compound can be dispensed with, which in the prior art—see, for example, DE 28 16 437 A1—is the most complex machine on an insulating glass production line.

Finally, the two ends of the hollow profile rod are connected to each other by a straight connector, which is inserted into both ends of the hollow profile rod. When feeding the hollow profile rod to the tools which are to be used for impressing it, the connector may already be inserted in one end of the hollow profile rod, so that after bending the hollow profile rod, the other end thereof only has to be placed on the existing connector.

In order to facilitate the bending operation, the profile rods have grooves or waves running at a right angle with respect to the glass panes, at least on the inside wall. Such grooves or waves are preferably also provided on the outside wall of the hollow profile rods. Each individual groove or wave defines a possible predetermined bending site and, if it is provided on the outside wall, facilitates an expansion of the outside wall during bending. The grooves or waves preferably end at a distance in front of the flanks in order to prevent undesirable, outwardly directly distortions of the flanks during bending.

If the partial regions of the flanks running parallel to each other and parallel to the glass plates extend up to the outside wall of the hollow profile rod, so that the rod is only narrower at the inside wall than at the outside wall thereof, the sealing compound is provided in the gap between the glass plates and the planar sections of the flanks parallel thereto in a thickness of 0.75 mm to 1.25 mm, in particular in a thickness of approximately 1 mm. This suffices in order to prevent the development of fine cracks in the sealing compound due to stresses resulting from fluctuating wind loads, fluctuating temperatures, and fluctuating outside air pressures. However, if hollow profile rods are used in which both the outside wall and the inside wall are narrower than the hollow profile rod as a whole, so that the flanks are recessed on both sides of the planar, central partial region thereof, the development of cracks in the sealing compound due to fluctuating pressure, temperature, and wind loads can already be prevented with a considerably thinner layer of the sealing compound in the gap between the planar central partial regions of the flanks and the adjoining glass plates, specifically with a thickness of the sealing compound of only 0.25 mm to 0.45 mm, preferably of only 0.3 mm to 0.4 mm. In order to produce such a thin layer of the sealing compound, the insulating glass pane does not have be pressed to a specified thickness in a controlled manner, it is rather sufficient to apply a specified specific pressure, for example 40 Newton per running centimeter of the circumference of the spacer, to the insulating glass pane.

The object of the present invention is finally a frame-shaped spacer for insulating glass panes, which is produced from a metallic hollow profile rod according to any one of the method claims.

In summary, the invention enables numerous advantages:

- It is possible to use hollow spacer frames, which are hermetically sealed and contain no desiccant. Such spacer frames are characterized by a particularly low heat transfer coefficient, in particular if they are made of stainless steel. Stainless steel is synonymous with a long service life, is not sensitive to UV light, has a low thermal expansion and low thermal conductivity, does not absorb moisture, and is diffusion-tight.
- The hollow and hermetically sealed spacer, the hollow space of which acts as an excellent insulator, acts as a double barrier with respect to the penetration of water vapor.
- The outside wall of the spacer can remain without sealing compound, so that the hollow and empty spacer as such is the only bridge between two glass panes of an insulating glass pane. This lowers the heat transfer between the two glass panes of an insulating glass pane and reduces the risk of condensation forming in the edge region of the insulating glass pane. At the same time, it results in a uniform surface temperature of the insulating glass pane.
- If any sealing compound is provided only in the joints between the spacer and the adjoining glass plates, minimal quantities of sealing compounds will suffice, without incurring any loss of the sealing effect and the service life of the insulating glass pane. The quantity of sealing compounds that is required is independent of the width of the spacer!
- The outside wall of the spacer can end flush with the edges of the glass plates, whereby the clear cross-section of the insulating glass pane is increased and the required installation depth in a window frame or door frame is reduced.
- The outside wall of the spacer can be pained, either for aesthetic reasons or to protect it.
- In particular when a spacer profile is used, in which both the outside wall and the inside wall are narrower than the hollow profile rod as a whole, the insulating glass pane can be pressed using a predetermined pressing pressure per running centimeter of the circumference of the spacer, and specifically such that the sealing compound at the thinnest site is only approximately 0.3 mm to 0.4 mm thick, which not only saves sealing compound, but at the same time increases the resistance to the penetration of water vapor. Stress loads in the sealing compound can be controlled by increasing the thickness with which the sealing compound is provided on the flanks of the spacer toward the inside wall and toward the outside wall of the spacer.

BRIEF DESCRIPTION OF THE DRAWINGS

Embodiments of the invention are illustrated in the attached drawings and described in more detail hereinafter. Identical and corresponding parts are denoted with agreeing reference numerals in the different embodiments.

DETAILED DESCRIPTION OF THE INVENTION

Figure 1:
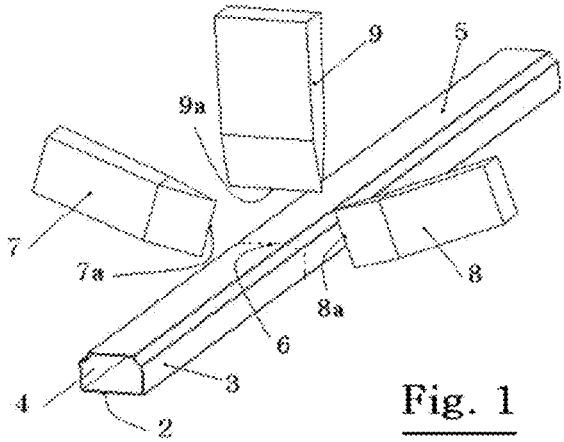
FIG. 1 shows an oblique view of a section of a hollow profile rod having three acute-angled notched chisels.
Figure 2:
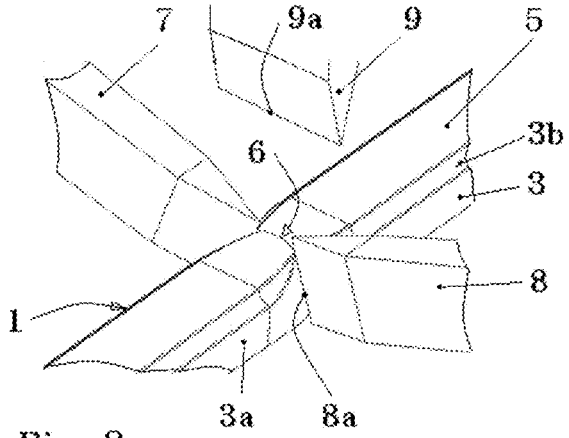
FIG. 2 shows an enlarged illustrated compared to FIG. 1 of the application of two notched chisels on the flanks of the hollow profile rod of FIG. 1.
Figure 3:
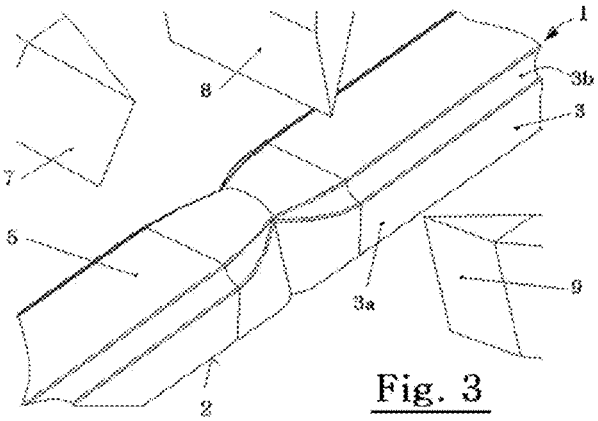
FIG. 3 shows the state of the hollow profile rod of FIG. 2 after impressing the two flanks.
Figure 4:
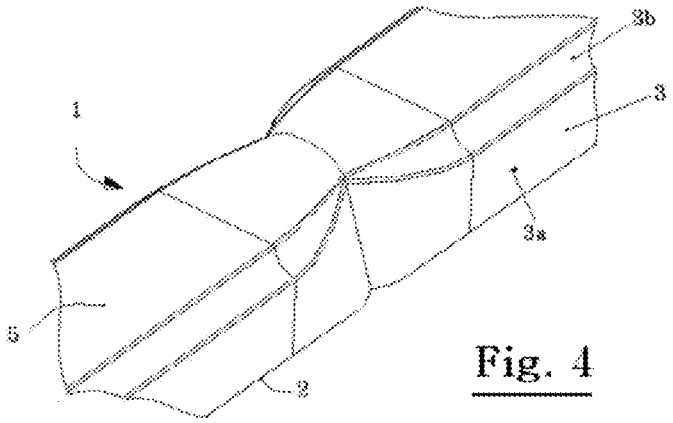
FIG. 4 shows an enlarged illustration of the result of FIG. 3.
Figure 5:
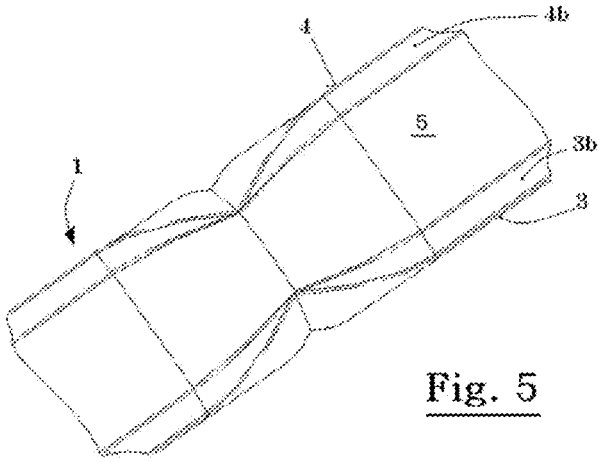
FIG. 5 shows a top view of the hollow profile rod of FIG. 4 that has been impressed at the flanks.

FIGS. 1 and 2 shows oblique views of a metallic hollow profile rod 1 having an approximately rectangular cross-section, as it is common for insulating glass panes. The hollow profile rod 1 has an outside wall 2, two flanks 3 and 4 that are parallel to each other, STOP and an inside wall 5 that is parallel to the outside wall 2. In a partial region 3*a*, 4*a* of the flanks 3 and 4 adjoining the outside wall 2, the flanks run parallel to each other and at a right angle to the outside wall 2. In a concave partial region 3*b*, 4*b* of the flanks 3 and 4 adjoining the inside wall 5, the hollow profile rod 1 is narrower than in the partial regions 3*a* and 3*b*. At the site 6 indicates with dashes in FIG. 1, a corner is to be formed in the hollow profile rod 1 by bending. For this purpose, in a first step, the flanks 3 and 4 are impressed at the predetermined site 6 using two chisels 7 and 8 that are located opposite of each other, as is shown in FIG. 2. The chisels 7 and 8 act on the flanks 3 and 4 at the intended site 6 with an acute-angled wedge, which ends in a rectilinear leading edge 7*a* or 8*a*, and push in at the full height, specifically more at the inside wall 5 than at the outside wall 2. The result of this deformation is shown in an oblique view in FIG. 3, in an enlarged oblique view in FIG. 4, and in a top view in FIG. 5. It is apparent that the impression of the flanks 3 and 4 at the level of the outside wall 2 has a lesser impact than at the level of the inside wall 5, which has buckled due to the impression of the flanks 3 and 4. Such buckling, but also vaulting, may occur at the outside wall 2.

Figure 6:
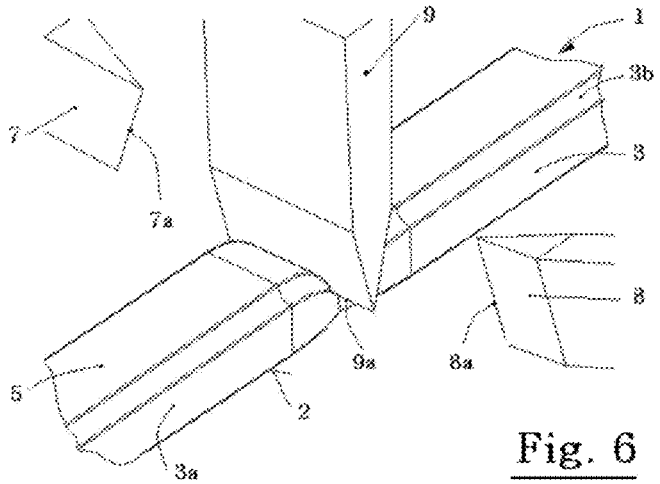
FIG. 6 shows an oblique view of the impression of the inside wall of the hollow profile rod of FIG. 5.
Figure 7:
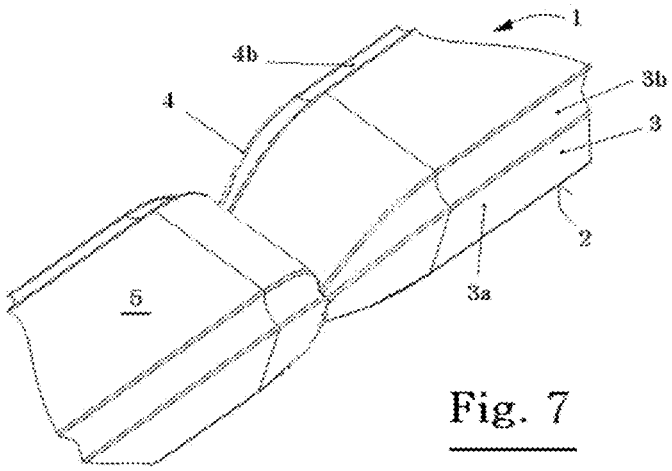
FIG. 7 shows the hollow profile rod of FIG. 6 after impressing the flanks and inside wall thereof.

Next, as is shown in FIG. 6, the inside wall is impressed using a wedge-shaped chisel 9, wherein the chisel 9 acts on the hollow profile rod 1 with the straight leading edge 9*a* thereof. In the process, the hollow profile rod 1 is impressed by two thirds to three quarters of the original height thereof. The result is shown in an oblique view in FIG. 7.

It should be noted that the chisels 7, 8, and 9 act on the hollow profile rod 1 at a right angle to the longitudinal direction of the rod, wherein the leading edges 7*a*, 8*a*, and 9*a*, which are preferably rounded with a small radius, are located in a common plane, in which the site 6 marked in FIG. 1 is also located, at which the chisels 7, 8, and 9 act on the hollow profile rod 1 with the respective leading edges 7*a*, 8*a*, and 9*a* thereof.

Figure 8:
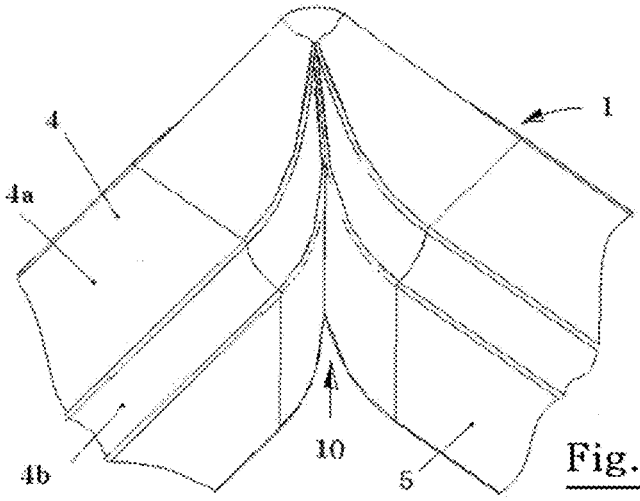
FIGS. 8 to 10 show different views of the hollow profile rod of FIG. 7 after bending a right-angle corner.
Figure 9:
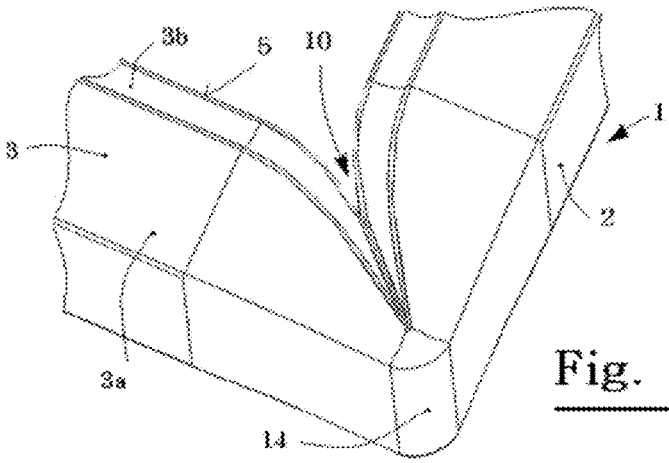
Figure 10:
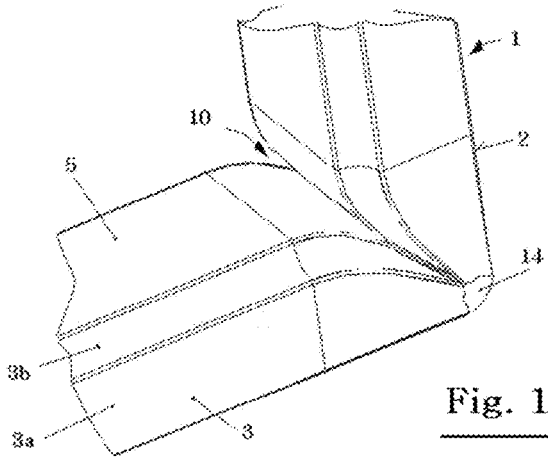

If the hollow profile rod 1 illustrated in FIG. 1 is bent by 90°, which can be done manually or by machine, a right-angled corner is created at the predetermined site 6, the corner having the shape illustrated in FIGS. 8 to 10. At the inside wall 5, it is still possible to view into a narrow gap 10, which has a symmetrical or approximately symmetrical configuration and a smooth contour, which lends a spacer frame that is installed with such corners into an insulating glass pane a pleasant appearance.

The impression of the inside wall 5 is not absolutely necessary, in particular when the inside wall 5 has waves or grooves running at a right angle to the planar sections 3*a* and 4*a* of the flanks, which will be described later.

Figure 35:
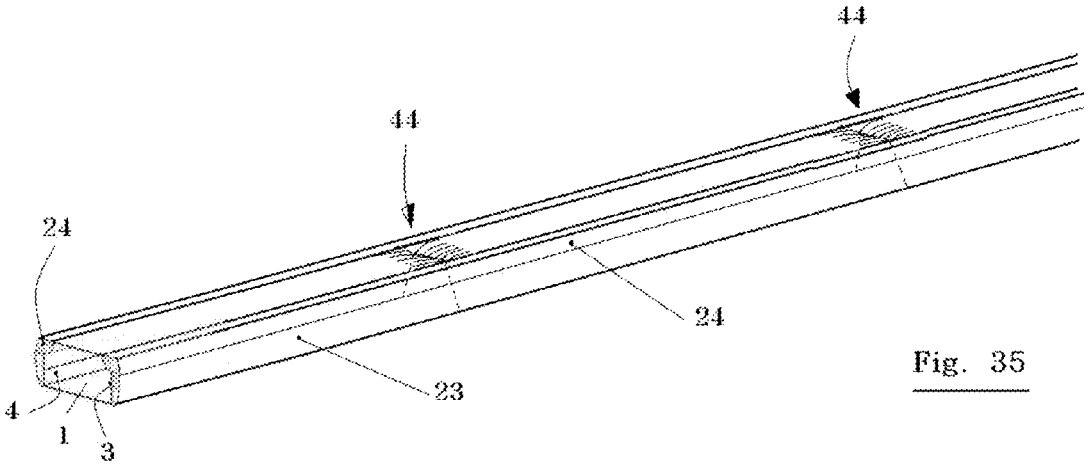
FIG. 35 shows the hollow profile rod after the flanks thereof have been coated.
Figure 36:
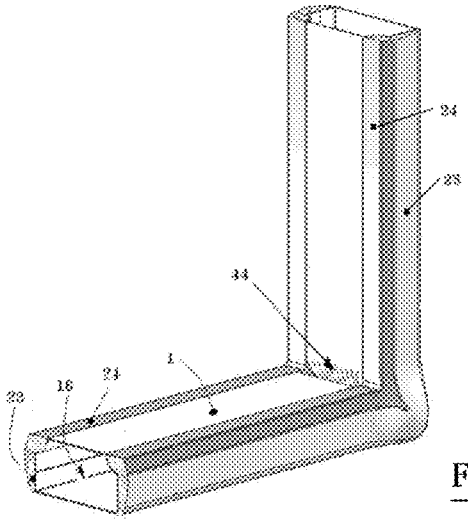
FIG. 36 shows the hollow profile rod of FIG. 35 after a corner has been bent.
Figure 37:
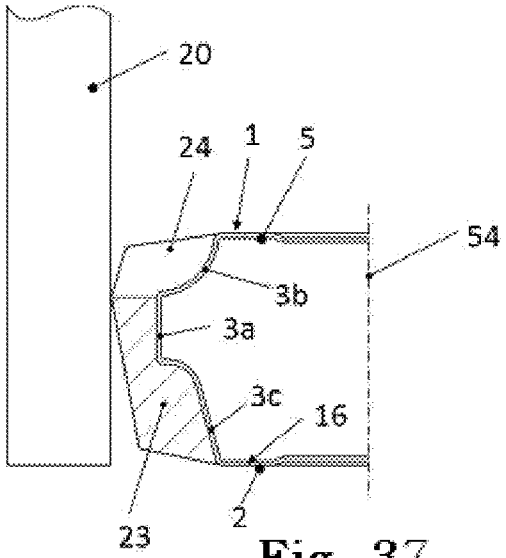
FIG. 37 shows a cross-section through a spacer half having a modified profile shape next to a glass plate, prior to pressing together the insulating glass pane.
Figure 38:
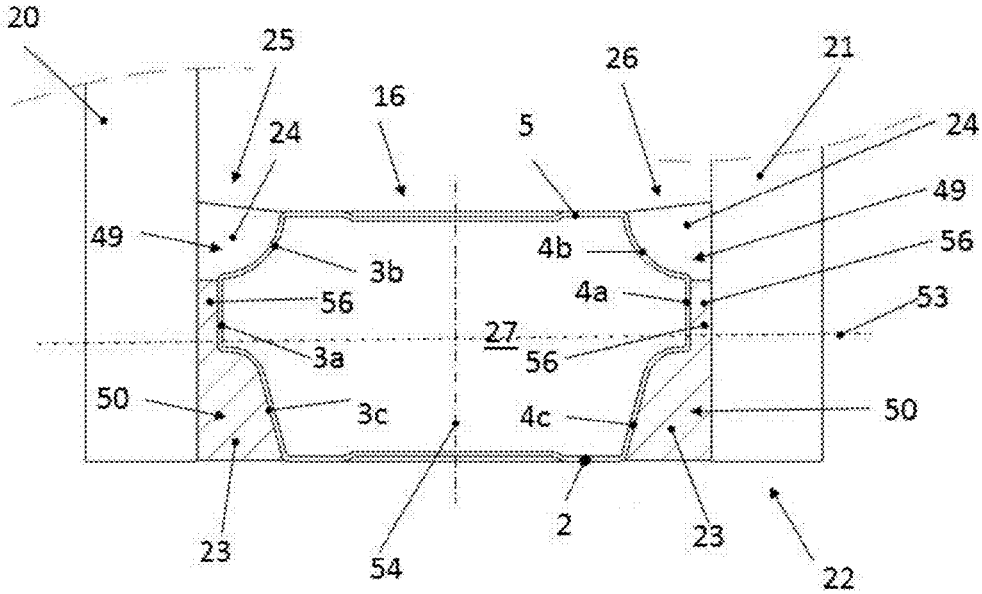
FIG. 38 shows a cross-section of part of a pressed insulating glass pane comprising a spacer having the profile shape of FIG. 37.
Figure 39:
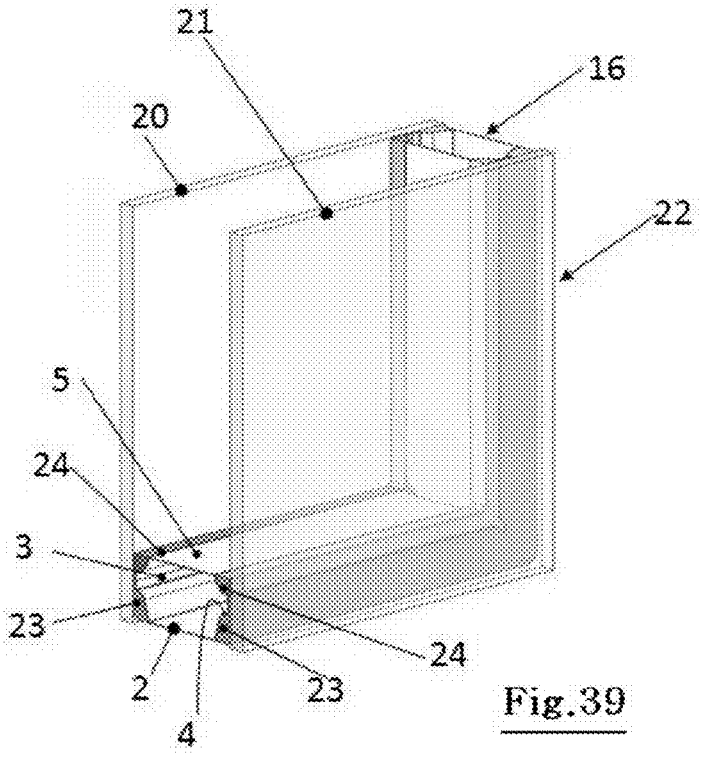
FIG. 39 shows an oblique view of a section of the insulating glass pane according to FIG. 38.
Figure 40:
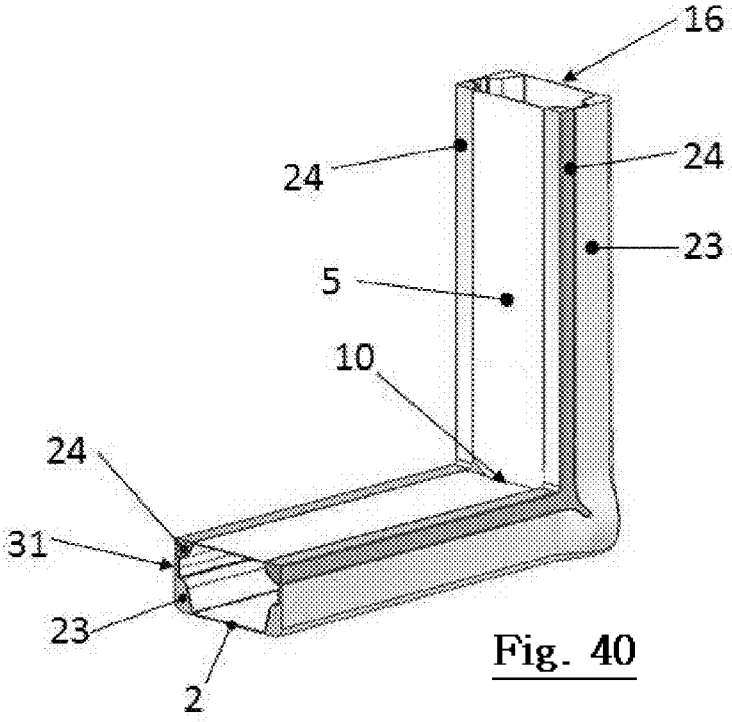
FIG. 40 shows an oblique view, as in FIG. 39, of the spacer of the pressed insulating glass pane according to FIG. 39, wherein the glass plates are not illustrated.

Since the spacer frame must be glued to the glass slabs of an insulating glass pane, an adhesive sealant or sealing compound is preferably applied to the flanks 3 and 4 after impressing, but prior to bending the hollow profile rod 1. FIG. 35 shows the hollow profile rod 1 after the flanks 3 and 4 thereof have been coated. A secondary sealing compound 23 was applied to the partial regions 3*a* and 4*a* of the flanks connecting to the outside wall 2 of the hollow profile rod 1 and, after setting, creates a firm bond between the spacer 16 and the two glass plates of the insulating glass pane. The secondary sealing compound 23 can be a mixed adhesive, such as Thiokol, or a reactive single-component adhesive. A thermoplastic sealing compound was applied to the partial regions 3*b* and 4*b* of the flanks adjoining the inside wall 5 and being recessed compared to the partial regions 3*a* and 4*a*, wherein the compound not only serves as a water vapor barrier (referred to as primary sealant), but is also used to absorb water vapor—because additionally a desiccant is embedded in this thermoplastic sealing compound 24. The desiccant-containing, primary sealing compound 24 and the setting secondary sealing compound 23, which here together are also referred to as sealants or sealing compounds, directly adjoin each other. Because of the bending operation, an excess of sealant or sealing compound is created in the corner region on the flanks 3 and 4 and ensures good sealing action of the insulating glass pane in the corner region, see FIG. 36. When pressing the assembled insulating glass pane together, the excess of sealant or sealing compound 23, 24 is distributed in the region of the corner and in the process also pressed into pleats of the spacer, which have developed as a result of the bending process of the corners. By pressing the insulating glass pane together, the sealant or sealing compound 23, 24 flows into the pleats of the flanks 3 and 4 and fills in the pleats.

Figure 11:
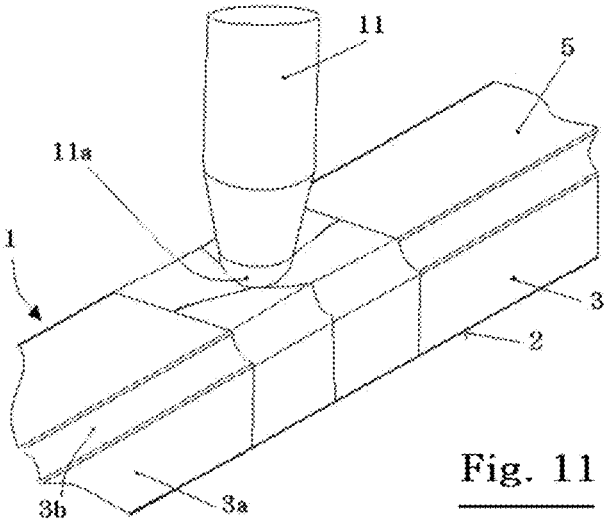
FIG. 11 shows an oblique view of a hollow profile rod, wherein a blunt tool acts on the inside wall at the site intended for a corner.
Figure 12:
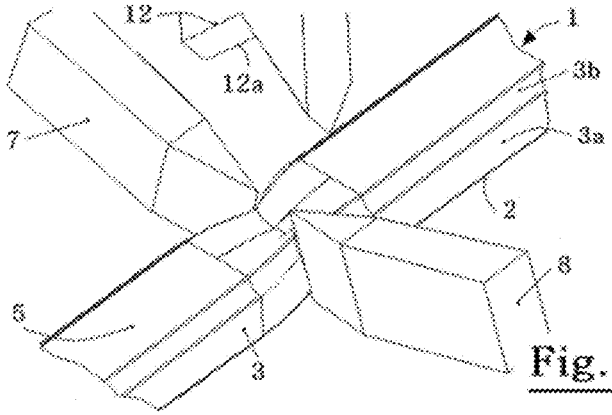
FIG. 12 shows the final impression of the flanks using two notched chisels on the hollow profile rod of FIG. 11.
Figure 13:
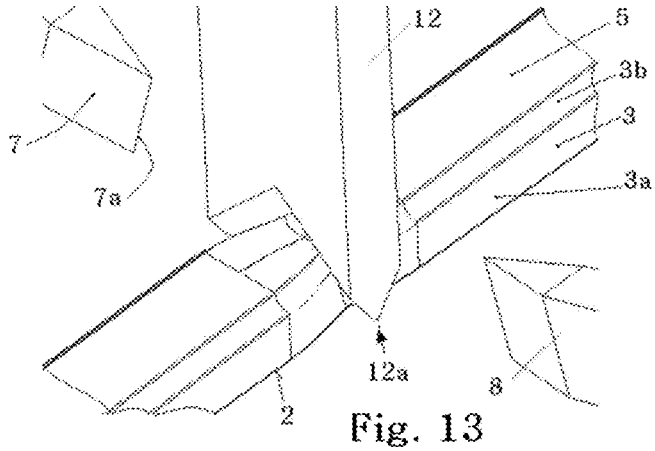
FIG. 13 shows the reshaping of the hollow profile rod for the hollow profile rod of FIG. 12 at the previously impressed site using a convex notched chisel, which is applied to the inside wall from above.
Figure 14:
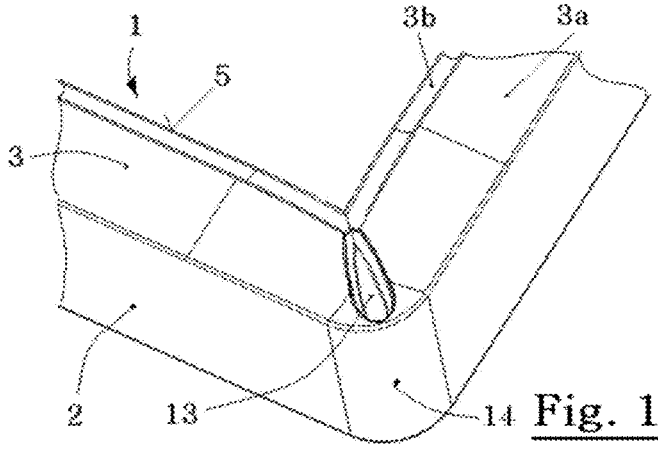
FIG. 14 shows a view obliquely onto the outside of the hollow profile rod of FIG. 13 after bending a right-angled corner.
Figure 15:
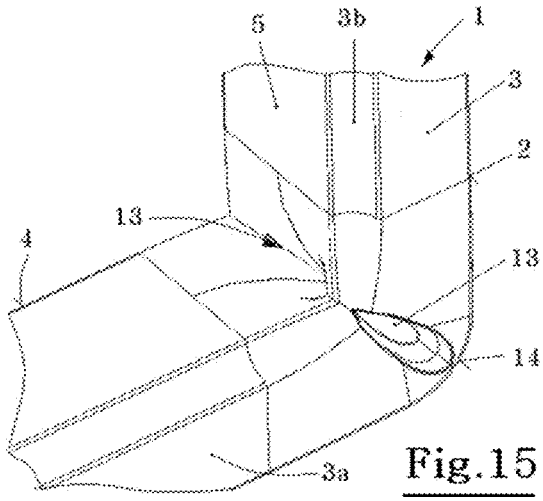
FIG. 15 shows a view obliquely onto the inside wall of the corner in the hollow profile rod of FIG. 14.

In the embodiment illustrated in FIGS. 11 to 15, the inside wall 5 of a metallic hollow profile rod 1 having a substantially rectangular cross-section, which is configured as in the first embodiment, is impressed initially using a blunt tool 11 at the site 6 intended for the corner, as is shown in FIG. 11. In this example, the tool 11 has a spherical cap-shaped tip 11*a*. After impressing the inside wall 5, the two flanks 3 and 4 are impressed in the same manner as in the first embodiment using chisels 7 and 8 of the kind as they were used in the first embodiment. In this way, the previously impressed inside wall 5 is further dented inward and the upper edges of the hollow profile rod 1 are slightly displaced toward each other. In a third step, preferably the pressure of a chisel 12 having a concave leading edge 12*a* is applied to the upper edges of the hollow profile rod 1 in order to optimize the contour of the impressed site of the hollow profile rod 1 for the subsequent bending operation. In the illustrated embodiment, the concave leading edge 12*a* has a wedge-shaped configuration. It is located in the same plane as the leading edges 7*a* and 8*a* of the chisels 7 and 8 required for impressing the flanks 3 and 4.

Figure 17:
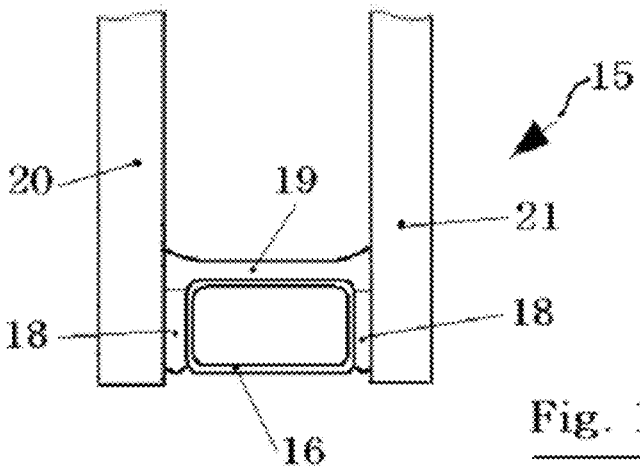
FIG. 17 shows a cross-section of the spacer frame installed in the insulating glass pane.

If a hollow profile rod 1 impressed in this manner is bent, a contour is created in the corner region which has an inwardly located pleat 13 having sufficient volume to accommodate an excess of a desiccant-containing compound forming in the region of the corner due to the bending of the corner and continuously applied previously to the inside wall 5 of the hollow profile rod 1, see also the coating on the flanks 3, 4 and on the inside wall 5 illustrated in FIG. 17 using the example of a hollow profile rod having an exact rectangular cross-section.

The outside 14 of the corner—as in the first embodiment—is evenly rounded and has a comparatively narrow radius of curvature.

The second embodiment is particularly suited for a procedure in which, after impressing the hollow profile rod 1, but after bending the corners, an adhesive sealant is applied to the flanks 3 and 4 and a desiccant-containing compound is continuously applied to the inside wall 5, wherein the inside wall 5 and the two flanks 3 and 4 are to be covered completely adjoining each other, as is illustrated, for example, in FIG. 17. By coating the inside wall 5, the spacer 16 is given a very appealing appearance in the insulating glass pane 15. At the same time, the corner is perfectly sealed by the prior application of the adhesive sealant in that an excess of the sealant applied to the inside wall 5 is displaced into the pleat 13 and an excess of sealant formed on the flanks 3 and 4 due to the bending of the corner—as in the example of FIGS. 25 and 26—is distributed in the corner region by the subsequent pressing of the insulating glass pane.

Figure 16:
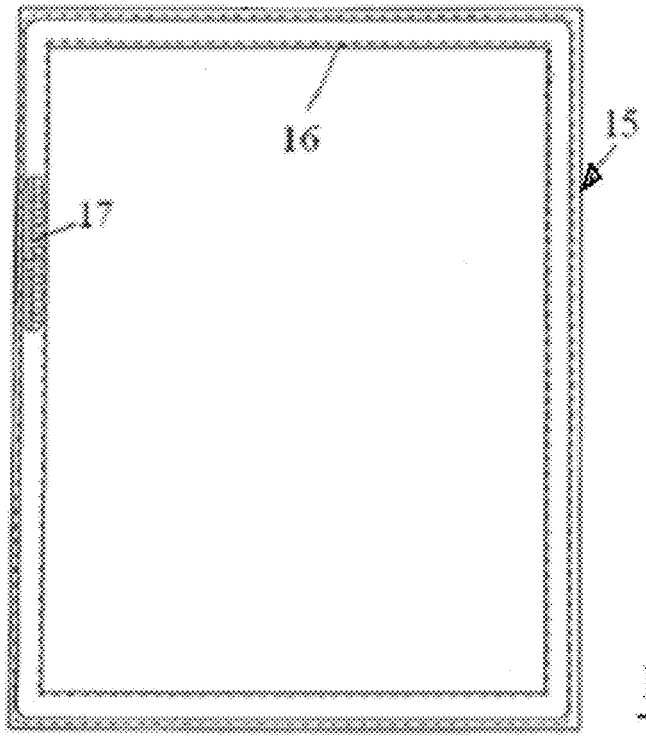
FIG. 16 shows a spacer frame which has been produced according to the invention and is installed in an insulating glass pane.

An insulating glass pane 22, the spacer 16 of which is coated on the flanks 3 and 4 and on the inside wall 5, is illustrated in FIGS. 16 and 17. FIG. 16 shows a side view of an insulating glass pane 15 having a modified rectangular spacer 16, the two ends of which are connected to each other by a straight connector 17. The spacer 16 is coated with a sealant 18 at the flanks 3 and 4 and with a desiccant-containing compound at the inside 5, the sealant and the compound directly adjoining each other and adhering to the spacer 16 as well as the two glass slabs 20 and 21 of the insulating glass pane 22, hermetically sealing the same.

It is particularly advantageous when one of the compounds 18 or 19 or both compounds 18 and 19 have setting properties, because then final sealing of an edge joint of the insulating glass pane using a setting mixed adhesive can be foregone. Accordingly, an edge joint is redundant and the spacer 16 can be configured and arranged such that it ends flush or approximately flush with the edge of the glass plates 20, 21, which is illustrated in FIG. 17. This is advantageous because a larger clearance width of the spacer becomes possible, and at the same time the thermal insulation of the insulating glass pane installed in a window frame is improved, since the heat flow to the spacer 16 having good conductive properties is worsened and heat conduction by way of an edge joint filled with the sealing compound is eliminated.

Figure 18:
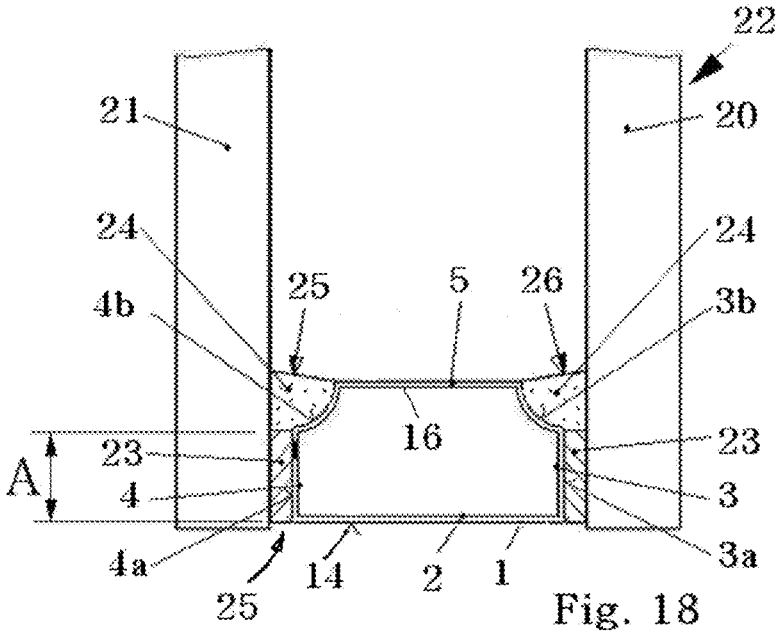
FIG. 18 shows a cross-section of a part of an insulating glass pane produced according to the invention.

FIG. 18 shows a section of an insulating glass pane 22, comprising two individual glass plates 20 and 21, between which a frame-shaped spacer 16 is located, which is formed by a hollow profile rod 1, which has a box profile cross-section and can be produced, for example, by extrusion. In the cross-section, the spacer 16 has an outside wall or base 2 having a planar outside. Two laterally reversed identical sides 3 and 4 extend from the base 2 and lead to a wall 5 that is parallel to the base 2, the upper side of which faces the inside space of the insulating glass pane 22. The wall 5 here is therefore also referred to as the inside wall of the spacer 16.

The sides 3 and 4 form the flanks of the spacer 16. Connecting to the base 2, they have two planar sections 3*a* and 4*a* which are parallel to each other and extend up to a specified distance A from the base 2. In each case, a concave section 3*b* or 4*b* connects thereon.

In the region of the parallel, planar wall sections 3*a* and 4*a*, a secondary sealing compound 23 is applied to the flanks 3 and 4, for example a single-component of mixed reactive adhesive, which rigidly connects the spacer 16 to the two glass plates 20 and 21 and cures. A compound 24 having a desiccant embedded therein is applied to the wall sections 3*b* and 4*b*. This compound 24 can be a primary sealing compound based on polyisobutylene, such as a TPS compound. The sections 3*a* and 3*b* as well as 4*a* and 4*b* of the flanks 3 and 4 of the spacer 16 can be coated in a single operation by way of coextrusion, more specifically preferred as long as the rod-shaped spacer profile is still in the extended position. After the coating step, an angular, in particular a rectangular, frame-shaped spacer 16 may be formed, for example by folding the profile rod 1 at the sites 6 intended for the corners. This can be done mechanically, but is also easy to do manually, wherein the folding step is particularly easy because the base 2 and the inside wall 5 of the spacer profile are without any coating of an adhesive compound, so that they can be gripped without difficulty. The desiccant-containing compound 24 and any other sealing compound 23 are located exclusively in the two joints 25 and 26 between the flank 3 and the glass plate 20 as well as between the flank 4 and the glass plate 21.

The inside space 27 of the spacer 16 is empty; it only contains air, but no desiccant. All the walls 2, 3, 4, and 5 thereof are sealed.

Figure 19:
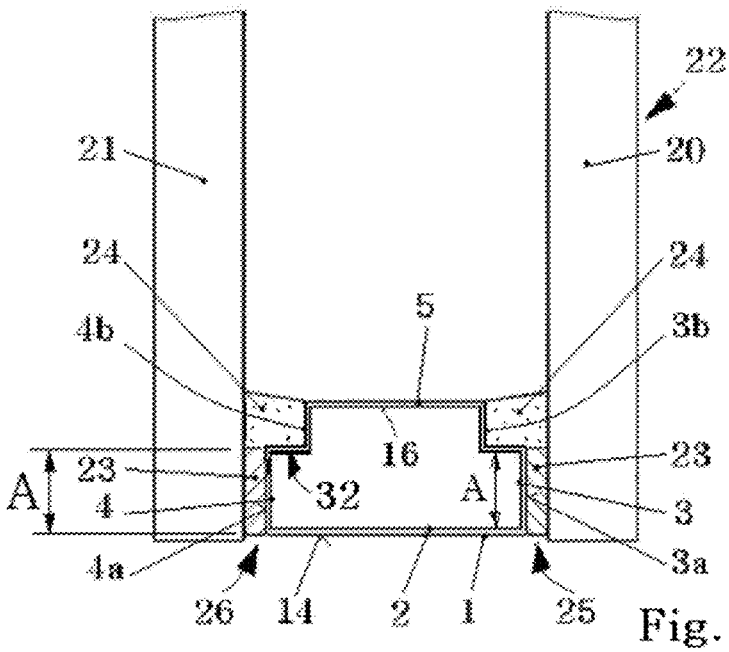
FIG. 19 is a cross-section of a variation of the insulating glass pane illustrated in FIG. 18.

The embodiment illustrated in FIG. 19 differs from the embodiment illustrated in FIG. 18 in that the spacer profile has no convex sections 3*b* and 4*b* at the flanks 3, 4, but instead is configured in a stepped manner, having a rectangular step.

Figure 20:
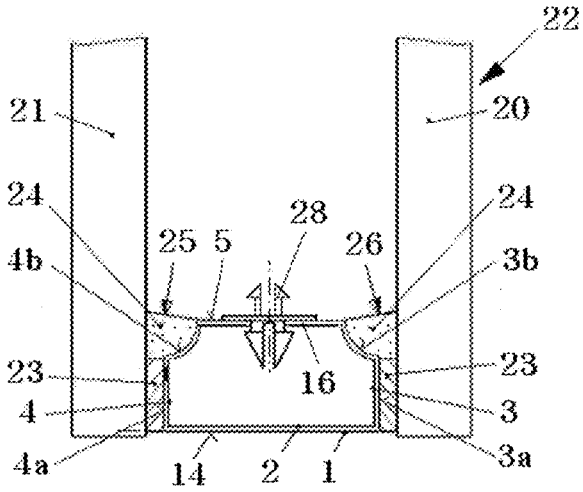
FIG. 20 is a cross-section of the insulating glass pane shown in FIG. 18, comprising an adapter for applying a muntin.
Figure 21:
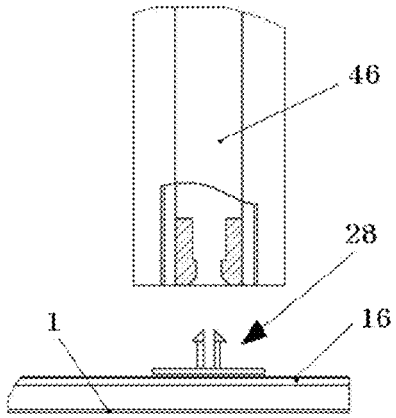
FIG. 21 shows an alternative for attaching an adapter to a spacer.

The embodiment illustrated in FIG. 20 differs from the embodiment illustrated in FIG. 18 in that adapters 28 are anchored on the inside wall 5 of the profile rod, onto which muntins 46 can be placed, as is shown in FIG. 21. The adapters 28 can be placed into the intended sites through a hole in the inside wall 5. The hole is preferably drilled at the intended site while the corners of the frame-shaped spacer 16 have not been shaped yet, this being while the hollow profile rod 1 has not been bent yet to form the corners, even before the desiccant-containing compound 24 and the other sealing compound 23 are applied to the flanks 3 and 4 of the hollow profile rod 1. A gap between the edge of the hole in the inside wall 5 and the adapter 28 can optionally be sealed using a sealant.

As an alternative, the adapter 28 for a muntin 26 may also be glued to the top side 34 of the hollow profile rod 1. This is shown in FIG. 21 and has the advantage that the hollow profile rod 1 is not damaged there.

Figure 22:
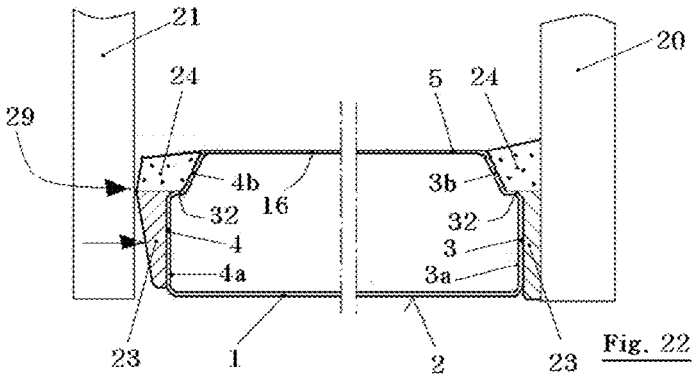
FIG. 22 shows a spacer profile, the cross-section of which has been modified with respect to FIGS. 18 to 20 and the flanks of which are coated with a primary and a secondary sealing compound, specifically on the left side of the figure prior to pressing together with a glass plate and on the right side after pressing together with a glass plate.

FIG. 22 shows that a primary sealing compound 24, which comprises a desiccant, and a secondary sealing compound 23 are preferably applied to the flanks 3 and 4 of the spacer 16 such that they directly adjoin each other from the start and the course of the thickness of the layer that is applied over the height of the spacer profile is selected such that the coated hollow profile rod 1, measured over the sealing compounds 23 and 24, is the widest where the two sealing compounds 23 and 24 come together. From there, the width of the coated spacer profile tapers both in the upward direction, this being in the direction of the upper side of the inside wall 5, and in the downward direction, this being toward the outside of the base 2 of the spacer profile, as is shown in the left half of FIG. 21. This has the advantage that during the subsequent pressing operation of the sealing compounds 23 and 24 between the spacer 16 and the two glass plates 20 and 21 the risk of trapping air bubbles between the sealing compounds 23 and 24 and the glass plates 20 and 21 is minimal. The pressing operation begins at the site 29 which meets the glass plate 20 or 21 first and at which the two sealing compounds 23 and 24 adjoin each other, from where it progresses upward and downward, so that the air can be displaced from the initially wedge-shaped gaps between the sealing compounds 23 and 24 and the glass plates 20 and 21. After concluding the pressing operation, the image illustrated in the right side of FIG. 21 is obtained.

Figure 23:
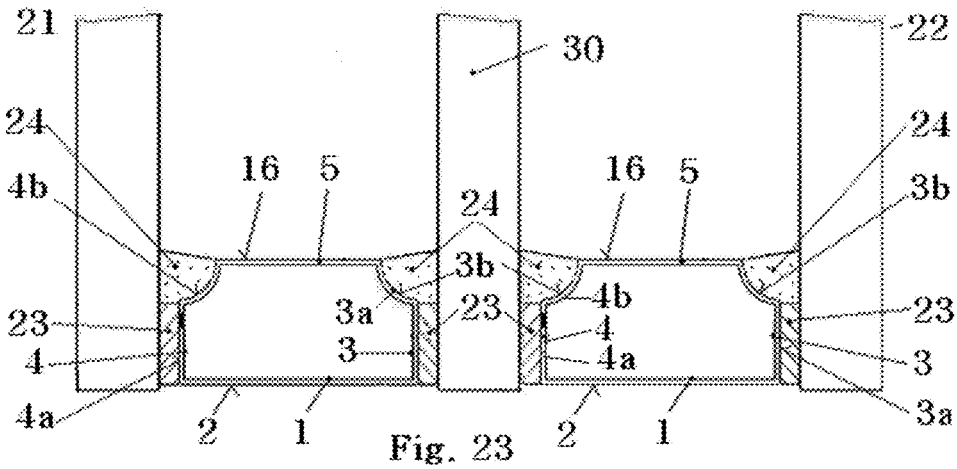
FIG. 23 shows an insulating glass pane in an illustration according to FIG. 18, which is composed of three glass plates and two spacers and produced according to the invention.

FIG. 23 shows the application of the invention to the production of a triple insulating glass pane, which comprises three glass plates 20, 21, and 30, which are held in pairs at a distance from each other in each case by a spacer 16. In both cases, the sealing compounds 23 and 24 are located exclusively in the interstice between the flanks 3 and 4 of the spacer 16 and the respectively adjacent glass plate 20, 21, and 30.

Figure 24:
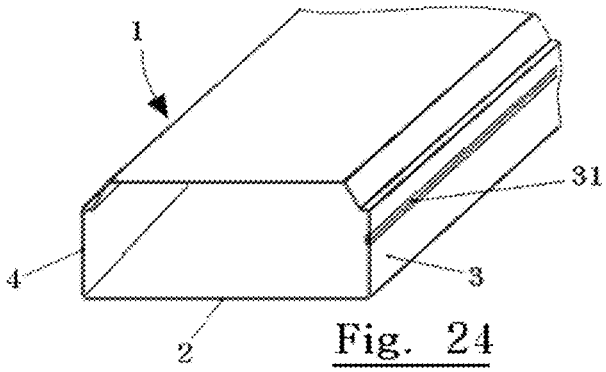
FIG. 24 shows an oblique view of a spacer profile having a seam located on a flank.

FIG. 24 shows a section of a hollow profile rod, from which a spacer can be implemented. The spacer has a profile as that shown in FIG. 19. It could also have a profile as that shown in FIG. 18. The hollow profile rod 1 is produced from a metal strip by roll forming. The two edges of the metal strip meet at a flank 4 of the hollow profile rod 1 and there form a longitudinal seam 31, the cohesion of which is ensured by welding the two edges using a laser. The longitudinal seam 31 should be welded such that it is tight. Such a longitudinal seam 31, however, it not necessary tight everywhere; it would be leaking or start to leak in some regions. It is therefore preferred to place it on a flank 4 of the hollow profile rod 1, on which it is covered by a sealing compound, whereby the longitudinal seam 31 becomes sealed in every case.

In all embodiments, it is preferred for the sealing compound 23, which is located in the gap between the planar walls 3*a* and 4*a* of the spacer 16 that are located parallel to the glass plates 20 and 21, to have a thickness of 0.75 mm to 1.25 mm, preferably approximately 1 mm in the finished insulating glass plate 22. For clarification purposes, it should be noted that in the example according to FIG. 19 this does not apply to the compound 24 located on the shoulder 32 between the sections 3*a* and 4*a* of the flanks 3 and 4 and the inside wall 5 of the spacer 16, but only to the sealing compound 23 located in the narrower gap beginning at the base 2 of the spacer profile and ending at the shoulder 32.

This is the difference from the prior art. According to the prior art, it is customary to press insulating glass pane such that the joint between the flanks of the spacer and the opposing glass panes is reduced down to approximately 0.3 mm. For this purpose, a pressure of typically 40 Newton per running centimeter of the circumference of the insulating glass pane is applied to the insulating glass panes at the height of the spacer. The larger thickness, which is preferred according to the invention, of the sealing compound in the gap between the flanks and the glass plates is achieved by pressing the insulating glass pane to a specified thickness, using not only the specified pressing pressure. According to the invention, rather the distance of the press plates, between which the insulating glass pane is pressed to the desired thickness, is precisely controlled, so as to in fact achieve the layer thickness of the sealing compound 23 stated above.

Figure 25:
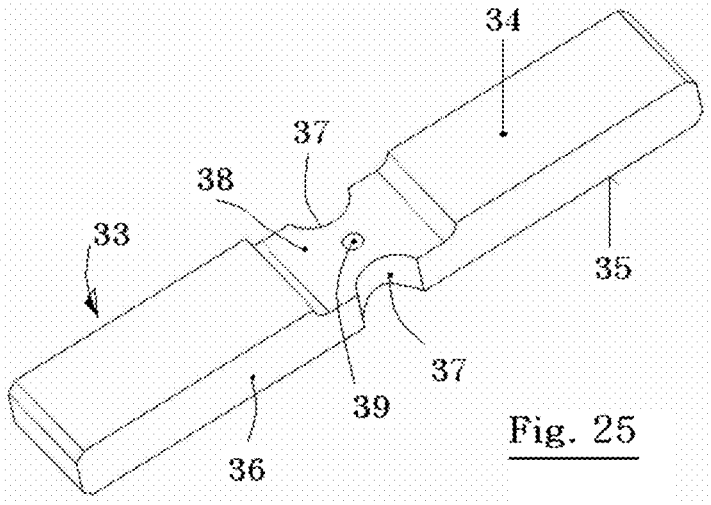
FIG. 25 shows an oblique view of a linear connector for connecting the two ends of the hollow profile rod, of which the spacer is formed.
Figure 26:
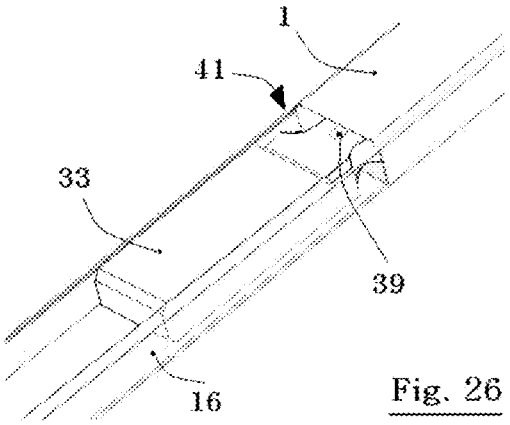
FIG. 26 shows an oblique view of the linear connector that is inserted in the two ends of the hollow profile rod, wherein the hollow profile rod is shown to be partially transparent.
Figure 28:
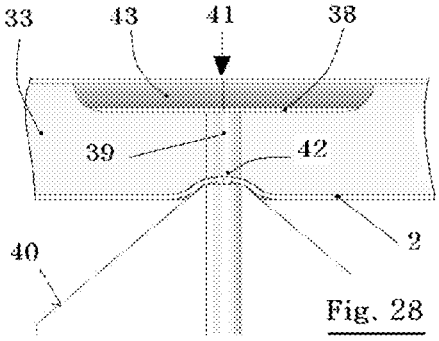
FIG. 28 is an enlarged illustration, in a longitudinal section through the hollow profile rod in the region of the linear connector, of the state after injecting the sealing compound.

When all corners of the spacers 16 are bent, the two corners of the hollow profile rod 1 are located opposite of each other and must be connected to each other in order to close the spacer 16. This connecting site should not be located on a corner of the spacer 16, but between two corners, so that the two ends of the hollow profile rod 1 are aligned with each other in the spacer 16. In order to connect the two corners of the hollow profile rod 1, advantageously a linear connector is inserted into the two corners of the hollow profile rod 1. An oblique view of a particularly suited linear connector is shown in FIG. 25. The linear connector 33 is a straight insert part, which is configured mirror-symmetrically to the center plane thereof cutting the linear connector in half in the length thereof. The linear connector has an upper side 34, a lower side 35, and two longitudinal sides 36. The longitudinal sides 36 are provided with two cutouts 37, which in the top view have a circular arc shape, in particular an approximately semicircular shape. In addition, a flat cutout 38 is provided in the center of the upper side 34, in the center of which a continuous hole 39 extending from the upper side 34 to the lower side 35 is located, in particular a borehole, The width and thickness of the linear connector 33 are adapted to the clearance width of the hollow profile rod 1, so that the linear connector 33 can be inserted therein with zero backlash after insertion into the hollow profile rod 1. The borehole 39 preferably expands conically, in a wedge shape or convexly toward the lower side 35, as is shown in FIG. 28. In this way, the linear connector 33 is surrounded by a waist through which the borehole 39 traverses.

The linear connector 33 has preferably already been inserted into the one end of the hollow profile rod 1 after the rod has been cut to the length necessary for forming the spacer 16 and before the hollow profile rod 1 is impressed at the sites intended for forming the corners. Advantageously, the linear connector 33 is inserted into the one end of the hollow profile rod 1 with half of the length thereof. In order to close the spacer 16, the free end of the linear connector 33 is inserted into the opposing end of the hollow profile rod 1, see FIG. 26. To ensure it does not shift in the end of the hollow profile rod 1 in which it has already been inserted, it is clamped in place temporarily, for example by way of tongs.

After the two ends of the hollow profile rod 1 have come together, the outside wall 2 of the spacer 16 is pushed over the conical, wedge-shaped or convex expansion of the hole 39 with a nozzle 40, which has a matching conical or convex tip, into the conical, wedge-shaped or convex expansion of the hole 39, wherein an opening 42, through which a sealing compound 43 can be injected into the spacer 16 by way of the nozzle 40, forms in the joint 41 between the two ends of the hollow profile rod 1. The sealing compound 43 flows through the borehole 39 into the flat cutout 38 on the opposite side of the linear connector 33, is distributed there and flows through the lateral cutouts 37 to the two flanks 3 and 4, and on to the inside of the outside wall 2 of the spacer 16. In this way, the joint 41 between the two ends of the hollow profile rod 1 is completely sealed from the inside out, without the sealing compound 43 exiting the joint 41. The joint 41 is thus not only reliably sealed, it is also very inconspicuous, which is advantageous for the appearance of the spacer 16 in the insulating glass pane. The position of the linear connector 33 in the two ends of the hollow profile rod 1 is secured by the impression of the outside wall into the expansion of the borehole 39 and by the injected sealing compound 43.

Figure 27:
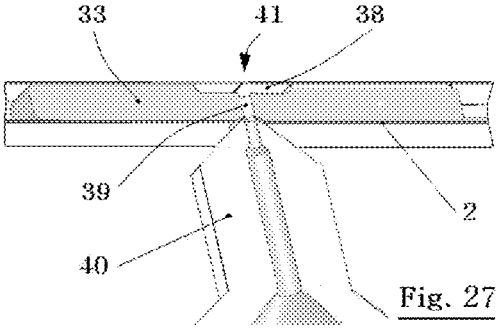
FIG. 27 shows a perspective view, in a longitudinal section through the hollow profile rod and through the linear connector, of the arrangement of the linear connector in the spacer prior to injecting the sealing compound.
Figure 29:
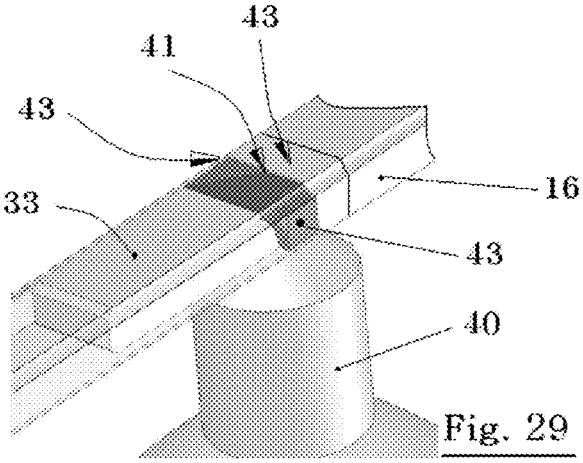
FIG. 29 shows in an oblique view of the hollow profile rod illustrated in a partially transparent manner how the sealing compound is distributed at the butt joint around the linear connector between the ends of the hollow profile rod.

FIG. 27 shows a perspective view, in a longitudinal section through the hollow profile rod 1 and through the linear connector 33, of the arrangement of the linear connector 33 in the spacer 16 prior to injecting the sealing compound 43 by way of the nozzle 40, which has already impressed the outside wall 2 of the spacer for this purpose. FIG. 28 shows an enlarged view, in a longitudinal section through the hollow profile rod, of the state after injecting the sealing compound. FIG. 29 shows in an oblique view of the hollow profile rod 1 illustrated in a transparent manner how the sealing compound 43 is distributed at the butt joint around the linear connector 33 between the ends of the hollow profile rod 1.

Figure 30:
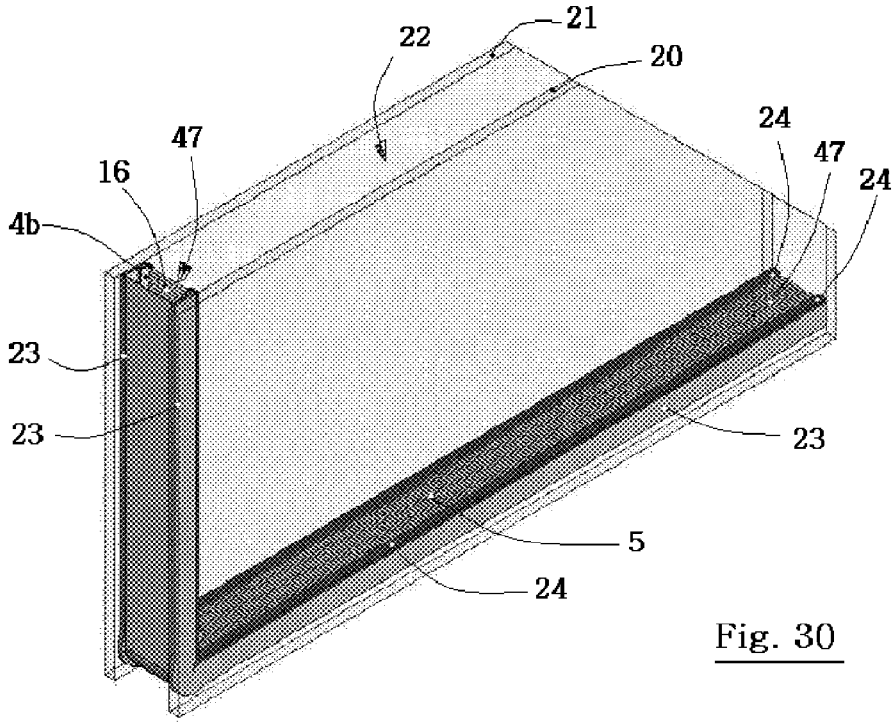
FIG. 30 is an oblique view of a section of an insulating glass pane comprising a spacer, which is coated with a primary and a secondary sealing compound.
Figure 31:
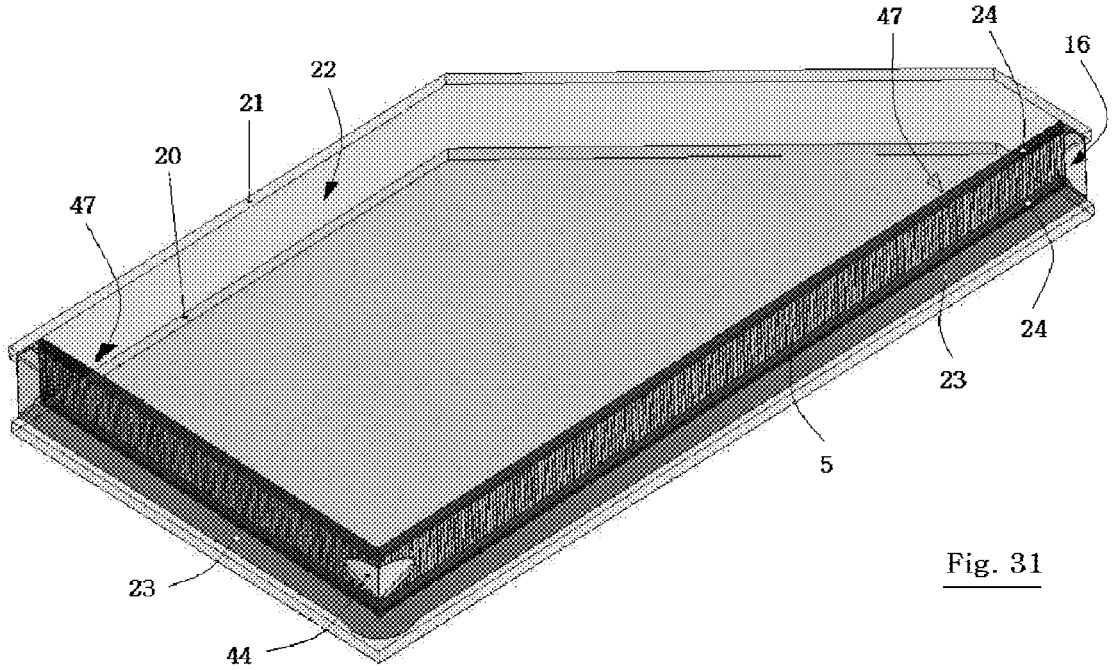
FIG. 31 shows an oblique view of the insulating glass pane of FIG. 30 at a different viewing angle.

FIGS. 30 and 31 show two oblique views of a section of an insulating glass pane 22 comprising a spacer 16, the corners of which are produced according to the method described based on FIGS. 11 to 15 and which, as is shown in FIG. 18 or 19 or 22, contains a desiccant-containing primary sealing compound 24 on the partial regions 3*b* and 4*b* of the flanks 3 and 4, while a setting secondary sealing compound 23 is applied to the partial regions 3*a* and 4*a* of the flanks 3 and 4. It is apparent that the excess of primary and secondary sealing compounds present in the corner region ensures particularly reliable sealing. At the same time, the corner provides an appealing appearance because the sealing compounds 23 and 24 are not pushed into the inner space of the insulating glass pane 22 due to the manner in which the corner has been produced. Also apparent is the indentation 44 on the inside of the corner, which has been generated by impressing the inside wall 5 using a convex tool 11. FIGS. 30 and 31 furthermore show a spacer 16, the inside wall 5 of which is provided with grooves 47 which run at right angles to the glass plates 20 and 21 and are provided at regular intervals and which facilitate the bending of the corners of the spacer 16 and can make a separate impressing step of the inside wall 5 of the hollow profile rod 1 prior to the bending operation redundant.

Figure 32:
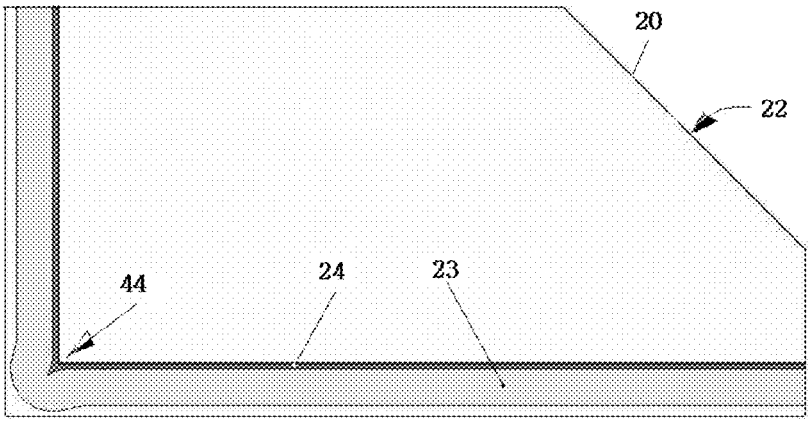
FIG. 32 shows a side view of the courses of the two sealing compounds in the insulating glass pane according to FIG. 30 and FIG. 31.

FIG. 32 shows a side view of the course of the two sealing compounds 23 and 24.

Figure 33:
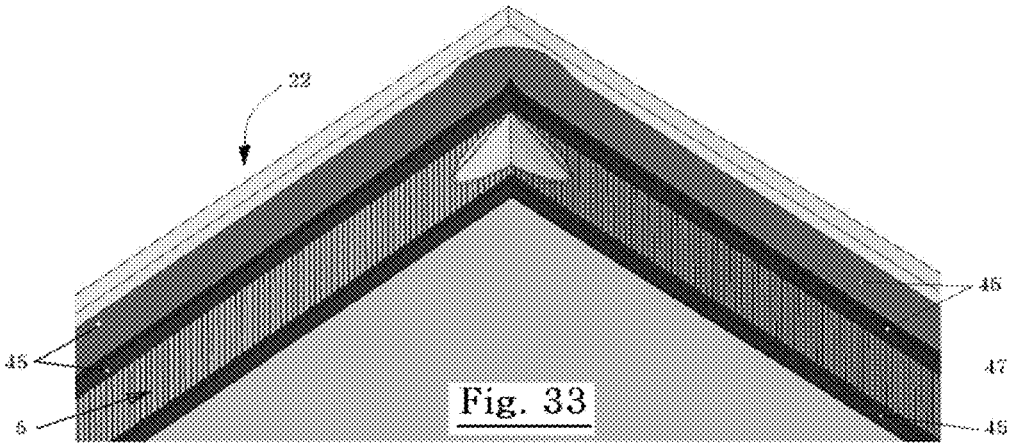
FIG. 33 is an oblique view of a section of an insulating glass pane comprising a spacer, which is coated with only a single sealing compound.

FIG. 33 shows an oblique view of a section of an insulating glass pane 22, in which contrary to the insulating glass pane illustrated in FIGS. 30 to 32 only a single sealing compound 45 is applied to the flanks of the spacer 16, wherein the compound comprises a desiccant and combines the functions of a primary and a secondary sealing compound, this being that it sets, constitutes a good barrier against the diffusion of water vapor, optionally binds diffused water vapor to the desiccant, and in this way keeps the dew point in the insulating glass pane 22 low. In this embodiment as well, the inside wall 5 of the spacer 16 is provided with grooves 47.

Figure 34:
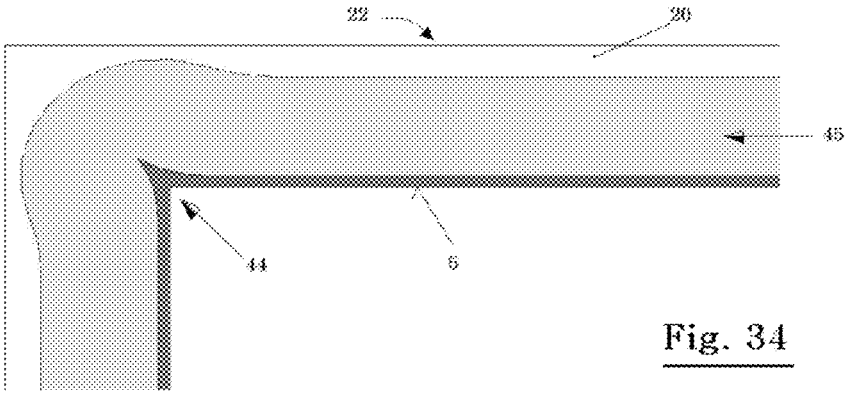
FIG. 34 shows a side view of a section of the insulating glass pane according to FIG. 33.

FIG. 34 shows a side view of a section of the insulating glass pane according to FIG. 33.

In the following embodiments, it is possible to press the insulating glass pane according to the invention using a specified pressure of, for example, 40 Newton per running centimeter of the circumference of the spacer or—if the circumference of the insulating glass pane agrees with the circumference of the spacer—per running centimeter of the circumference of the insulating glass pane; for this case, preferably a spacer profile is used which is shown, by way of example, in FIGS. 37 to 41. In this example, the planar partial regions 3*a* and 4*a* of the flanks that are parallel to the glass plates 20 and 21 are configured narrower than in the previous examples, and a further concave partial region 3*c* or 4*c* is provided between the outside wall or the base 2 of the spacer 16 and the planar partial surfaces 3*a* and 4*a* of the flanks parallel to the glass plates 20 and 21, wherein said concave partial region forms two further interstices 50 between the spacer 16 and the glass plates 20 and 21 in the insulating glass pane 22, which extend from the gaps 56 between the glass plates 20 and 21 and the respectively opposing partial regions 3*a* and 4*a* to the base 2 and accommodate a sealing compound, preferably a setting secondary sealing compound 23. The interstices 50 are added to the interstices 49, which are provided and adjoin the inside wall 2 and accommodate a primary sealing compound 24, which comprises a desiccant.

Such a spacer profile has two key advantages: For one, it allows the glass plates 20 and 21 to deflect as a result of fluctuations of the outside air pressure, under wind load, and under the effect of heat, without fine cracks developing in the secondary sealing compound 23, and in particularly in the primary sealing compound 24, which could result in leaks. In addition, when the interstices 49 have a different size from the interstices 50, such a spacer profile can optionally be processed into a spacer 16 and integrated in an insulating glass pane 22 such that the larger interstice 50 is located on the outside (see FIG. 38) when in the joints 25 and 26 a larger quantity of secondary sealing compound 23 than primary sealing compound 24 with an embedded desiccant is desired, or located on the inside (see FIG. 39) when in the joints 25 and 26 a larger quantity of primary sealing compound 24 with an embedded desiccant than secondary sealing compound 23 is desired.

Figure 41:
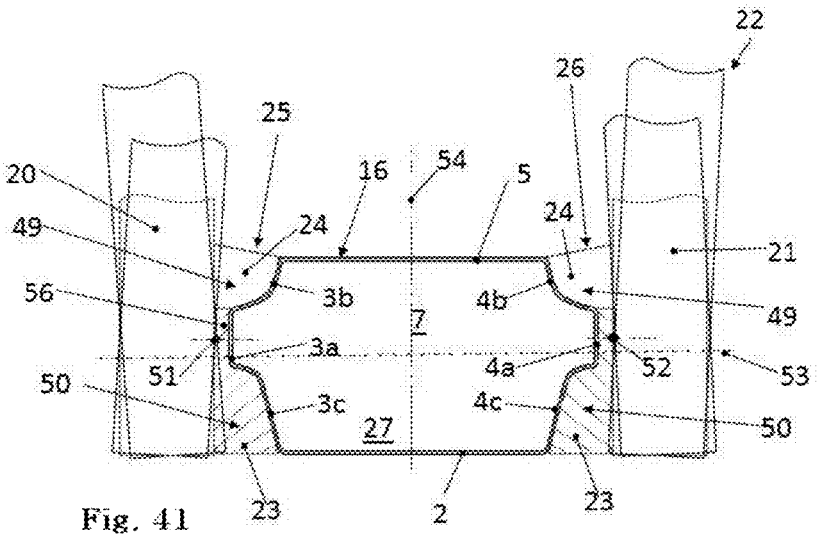
FIG. 41 shows a schematic illustration, in a cross-section of part of an insulating glass pane as in FIG. 38, how the insulating glass pane behaves during fluctuating deflections of the glass plates thereof.

FIG. 41 illustrates how an insulating glass pane 22 comprising such a spacer 16 behaves when the glass plates 20 and 21 of the insulating glass pane 22 are subjected to deflection stress. The thick lines indicate the glass plates 20 and 21 in a state in which they are not exposed to bending stress. The thin lines show the same glass plates when they are subjected to bending stress in one or the other direction. With respect to the spacer 16, they behave during bending stress as if a virtual hinge or a virtual pivot axis 51 or 52 extending the longitudinal direction of the flank 3 or 4 were located at the height of the planar partial regions 3*a* and 4*a* of the flanks 3 and 4. In the vicinity of the virtual pivot axis 51, 52, the degree of the movement of the glass plates 20, 21 is the smallest, so that even with the thin layer of secondary sealing compound 23 in the gap between the glass plates 20 and 21 on the one side, and the planar partial regions 3*a* and 4*a* on the other side, the movement of the glass plates 20 and 21 does not cause the primary sealing compound 24 and the secondary sealing compound 23 to tear. At a larger distance away from the virtual pivot axis 51, 52 at the height of the inside wall 5 of the spacer 16 and at the height of the base 2 of the spacer 16, the degree of the movements of the glass plates 20 and 21 is larger, however the forces pulling there on the secondary sealing compound 23 and on the primary sealing compound 24 containing the embedded desiccant are distributed over the considerably larger widths of the joints 24, 25, and 26, so that no cracks are formed there either in the primary sealing compound 24 containing the embedded desiccant or in the secondary sealing compound 23.

In the example of FIGS. 37 to 41, the "further" interstices 50 adjoining the base 2 are larger than the interstices 49 adjoining the inside wall 5 of the spacer 16. As a result, the spacer profile in the embodiment of FIGS. 37 to 41 is non-symmetrical with respect to a longitudinal center plane 53 through the hollow profile rod 1, which runs at a right angle to the planar intermediate regions 3*a* and 4*a* of the flanks. However, the hollow profile rods 1 are mirror-symmetrical with respect to the other longitudinal center plane 54, which runs parallel to the planar intermediate regions 3*a* and 4*a* of the flanks.

Figure 49:
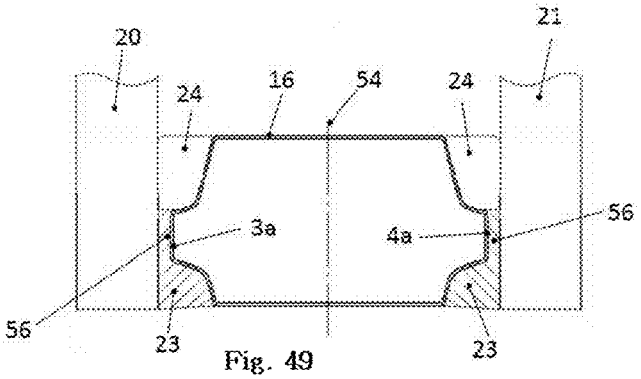
FIG. 49 shows a cross-section of part of an insulating glass pane having a spacer profile as in FIGS. 37 to 41, however installed contrary thereto in a reversed manner.

FIG. 49 shows that hollow profile rods 1 having the profile shape illustrated in FIGS. 37 to 41 can also be shaped oriented inversely to a spacer 16 and installed in the insulating glass pane 15, which is to say that the wall forming the base 2 in FIGS. 37 to 41 forms the inside wall of the spacer 16 in FIG. 49, while the wall forming the inside wall 5 of the spacer 16 in FIGS. 37 to 41 has become the base in FIG. 49.

Figure 42:
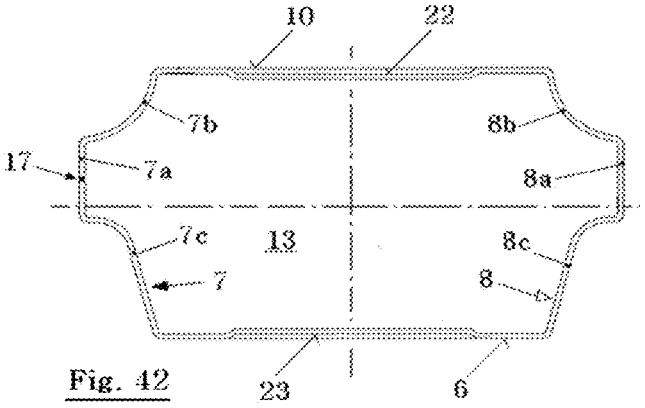
FIG. 42 shows a cross-section of a spacer of the type illustrated in FIGS. 37 to 41, however wherein the base of the spacer profile and the opposing top of the spacer profile are additionally provided with grooves.
Figure 43:
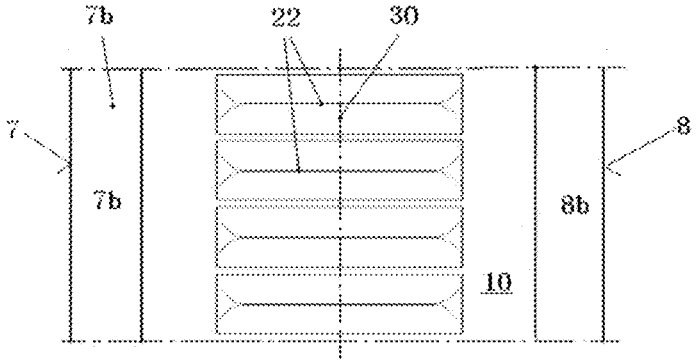
FIG. 43 shows a top view of a section of the spacer of FIG. 42, FIGS. 44 to 48 show illustrations, which correspond to FIGS. 37 to 41, of an insulating glass pane having a spacer profile that is modified compared to FIGS. 37 to 41.
Figure 44:
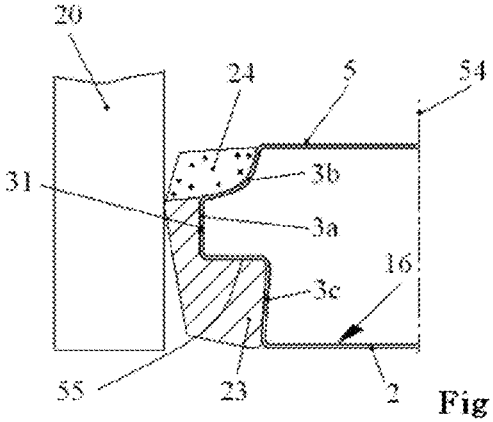
Figure 45:
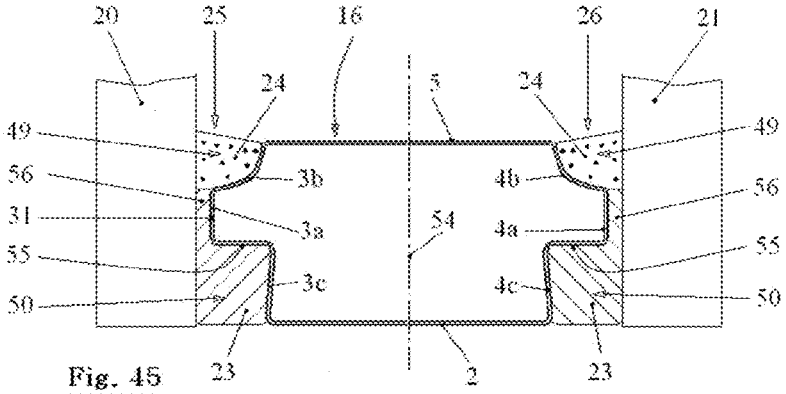
Figure 46:
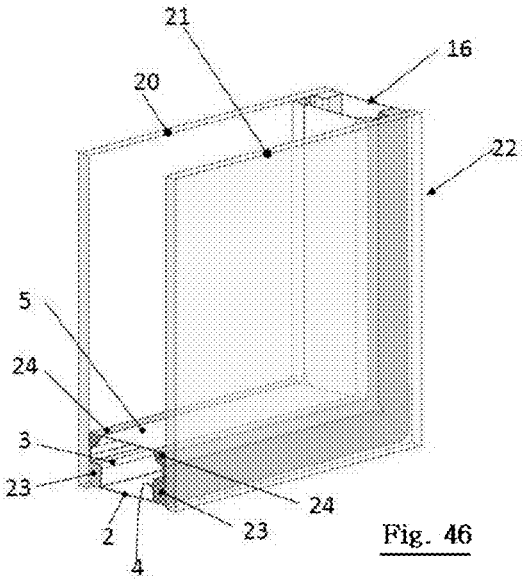
Figure 47:
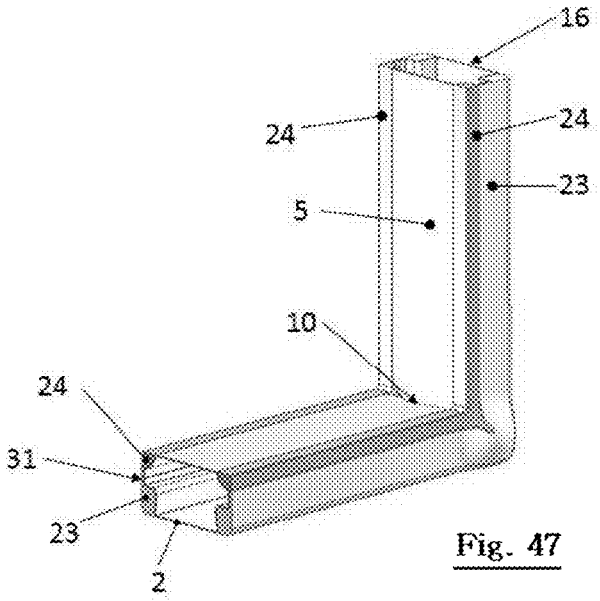
Figure 48:
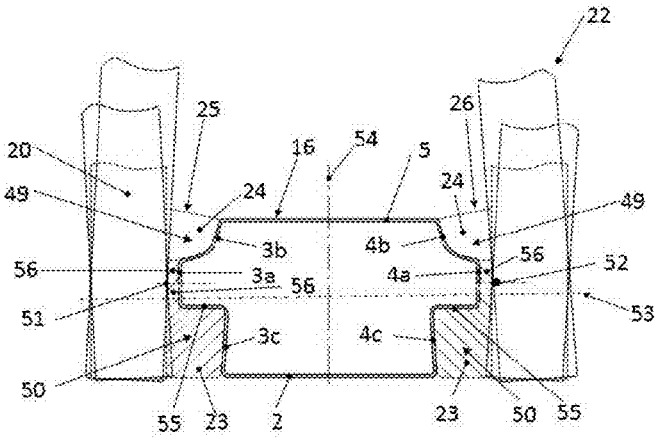

FIGS. 42 and 43 show a refinement of the spacer 16 illustrated in FIGS. 37 to 41. The variation consists in both the base 2 and the inside wall 5 being continuously provided with grooves 48 which extend at a right angle to the planar intermediate regions 3*a* and 4*a* of the flanks, maintain a distance to the flanks 3, 4, all have a uniform configuration, and are equidistant among ach other. These grooves 48 can be produced by embossing. They facilitate the bending or folding of corners of the spacer 16. Because of this advantage, grooves 48 are preferably provided. They are suited for all embodiments of the present invention.

The embodiment illustrated in FIGS. 44 to 48 differs from the embodiment illustrated in FIGS. 37 to 41 only in the space of the interstices 50 adjoining the base 2 of the spacer 16. While in the example of FIGS. 37 to 41 the interstices 50 steadily increase, starting from the planar intermediate regions 3*a* and 4*a* toward the base 2, they increase steadily starting from the base 2 toward the planar intermediate regions 3 and 4*a* in the embodiment of FIGS. 44 to 48, whereby, as viewed from the base 2, an undercut is created, which ends at a wall 55 which is parallel to the base 2 and delimits the planar intermediate region 3*a* or 4*a* in the outward direction, this being in the direction toward the base 2.

With respect to deflection movements of the glass plates 20 and 21, the insulating glass pane illustrated in FIGS. 44 to 48 behaves similarly to the insulating glass pane illustrated in FIGS. 37 to 41.

Figure 50:
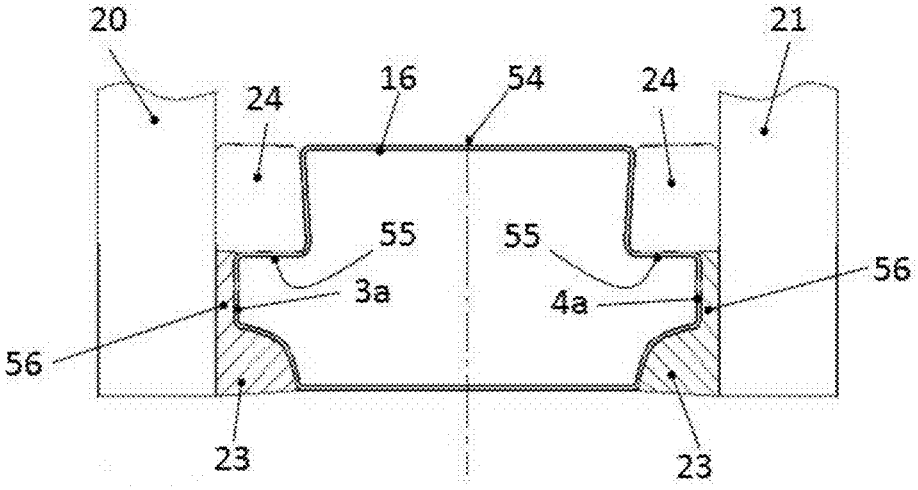
FIG. 50 shows a cross-section of part of an insulating glass pane having a spacer profile as in FIGS. 44 to 48, however installed contrary thereto in a reversed manner.

FIG. 50 shows that the profile shape used in the embodiment of FIGS. 44 to 48 also conversely can be processed into a frame-shaped spacer and inserted in an insulating glass pane.

LIST OF REFERENCE NUMERALS

1. Hollow profile rod
2. Outside wall, base
3. Flank

3*a/b/c*. Partial regions of the flanks
4. Flank
4*a/b/c*. Partial regions of the flanks
5. Inside wall
6. Intended site
7. Chisel
7*a*. Leading edge
8. Chisel
8*a*. Leading edge
9. Chisel
9*a*. Leading edge
10. Narrow gap
11. Tool
11*a*. Spherical cap-shaped tip
12. Chisel
12*a*. Leading edge
13. Pleat
14. Outside
15. Insulating glass pane
16. Spacer
17. Connector
18. Sealant
19. Desiccant-containing compound
20. Glass slab, glass plate
21. Glass slab, glass plate
22. Insulating glass pane
23. Secondary sealing compound
24. Desiccant-containing compound, primary sealing compound
25. Joint
26. Joint
27. Inner space of 16
28. Adapter
29. Site where 22 and 23 meet
30. Glass plate
31. Longitudinal seam
32. Shoulder
33. Linear connector
34. Upper side
35. Lower side
36. Longitudinal sides
37. Cutout
38. Cutout
39. Hole, borehole
40. Nozzle
41. Joint
42. Opening
43. Sealing compound
44. Indentation
45. Sealing compound
46. Muntin
47. Grooves
48. —
49. Intermediate space
50. Additional intermediate space
52. Virtual hinge, virtual pivot axis
53. Longitudinal center plane
54. Longitudinal center plane
55. Wall
56. Gap

The invention claimed is:

1. A method for producing a corner of a frame-shaped spacer for insulating glass panes, said method comprising:

(a) preparing a hollow profile rod, which comprises an outside wall, two parallel flanks that are parallel to each other, and an inside wall that is parallel to the outside wall, wherein the two parallel flanks adjoin the outside and inside walls;

(b) impressing each of the two parallel flanks at a corner formation site; and (c) bending the hollow profile rod about the inside wall at the corner formation site to a specified angle; the method further including the step of impressing the inside wall of the hollow profile rod at a corner formation site before bending the hollow profile rod about the inside wall.

2. The method according to claim 1 wherein the impressing of the hollow profile rod is carried out without opening one of the inside and outside walls.

3. The method according to claim 1 wherein the hollow profile rod is impressed and bent in an empty state.

4. The method according to claim 1 wherein the flanks are left to free action of impression forces when bending the hollow profile rod.

5. The method according to claim 1 wherein the hollow profile rod has no wall openings.

6. The method according to claim 1 wherein the hollow profile rod is produced by extrusion.

7. The method according to claim 1 wherein the hollow profile rod has a rectangular or approximately rectangular cross-section.

8. The method according to claim 1 wherein the hollow profile rod is narrower in a partial region adjoining the inside wall than in a partial region adjoining the outside wall.

9. The method according to claim 1 wherein an adhesive sealant is applied to the flanks after impressing, but prior to bending the hollow profile rod, the sealant extending substantially over the entire length of the hollow profile rod, to include the impressed sites of the flanks.

10. The method according to claim 9, wherein an adhesive compound containing a desiccant is applied to the inside wall of the hollow profile rod and extends substantially over the entire length of the hollow profile rod to include the impressed site of the inside wall.

11. The method according to claim 9 wherein an adhesive compound containing a desiccant is applied to a recessed partial region of the hollow profile rod and extends substantially over the entire length of the hollow profile rod to include the impressed sites of the flanks is applied to the flanks of the hollow profile rod.

12. The method according to claim 11 wherein the desiccant-containing compound is only applied to the flanks.

13. The method according to claim 12 wherein the desiccant-containing compound is applied to the flanks adjoining the inside wall.

14. A method according to claim 8 wherein the desiccant-containing compound is applied to the flanks of the profile rod at least in the narrow partial region thereof.

15. A method according to claim 10 wherein the adhesive sealant and the desiccant-containing adhesive compound are applied to the hollow profile rod so that they directly adjoin each other.

16. A method according to claim 10 wherein the compound receiving the desiccant and the adhesive sealant which is applied as a primary sealing compound to the flanks are the same.

17. A method according to claim 10 wherein the desiccant-containing compound and the adhesive sealant which is applied to the flanks are applied in a common operation to the hollow profile rod.

18. The method according to claim 16 wherein the sealant serving as the primary sealing compound at the same time contains the desiccant, so that the desiccant-containing compound at the same time is the compound that serves as the primary sealing compound.

19. A method according to claim 9 wherein any sealing compound is exclusively applied to the flanks of the hollow profile rod.

20. The method according to claim 19 wherein only a setting, desiccant-containing sealing compound is applied to the flanks which not only brings about the sealing action typical of an insulating glass pane to prevent the penetration of moisture into the insulating glass pane, but also, due to the setting thereof, brings about a permanently rigid connection of the glass plates in an insulating glass pane comprising the frame-shaped spacer.

21. A method according to claim 1 wherein a hollow profile rod is used, the inside wall and outside wall of which are narrower than the hollow profile rod.

22. The method according to claim 1 wherein a hollow profile rod is used, which has a non-symmetrical configuration with respect to the longitudinal center plane intersecting the flanks.

23. The method according to claim 22 wherein a hollow profile rod is used, wherein the cross-section of a recessed partial regions on the side of the longitudinal center plane intersecting the flanks is smaller than the cross-section of the recessed partial regions on the other side of this longitudinal center plane.

24. A method according to claim 1 wherein the hollow profile rod is impressed using a chisel having a rectilinear leading edge which during the impression process runs at a right angle to the longitudinal direction of the hollow profile rod.

25. The method according to claim 24 wherein the leading edge of the chisel is rounded.

26. The method according to claim 1 wherein a width of the outside wall is smaller than a width of the hollow profile rod as a whole, wherein when each of the two parallel flanks are impressed the edges of the outside wall are not impressed.

27. A method according to claim 1 wherein the flanks are impressed with a penetration depth that increases from the outside wall in the direction of the inside wall or up to the inside wall.

28. The method according claim 1 wherein the two flanks are impressed simultaneously.

29. The method according to claim 1 wherein initially the two flanks are impressed and then the inside wall of the hollow profile rod is impressed, and specifically in a wedge-shaped manner.

30. The method according to claim 1 wherein the inside wall of the hollow profile rod is impressed using a blunt tool.

31. The method according to claim 30 wherein the blunt tool which is used to impress the inside wall of the hollow profile rod has a convex front.

32. The method according to claim 30 wherein the blunt tool which is used to impress the inside wall of the hollow profile rod has an elongated front as viewed from above.

33. The method according to claim 32 wherein the blunt tool which is used to impress the inside wall of the hollow profile rod has a planar front or a wedge-shaped front, the wedge surfaces of which include an obtuse angle with each other.

34. The method according to claim 30 wherein initially the inside wall of the hollow profile rod is impressed using a blunt tool and then the two flanks are impressed using chisels.

35. The method according to claim 34 wherein after impressing the flanks, the impressed site of the hollow profile rod is reshaped using a chisel, which has a concavely extending leading edge.

36. The method according to claim 1 for producing a spacer frame for insulating glass panes, wherein initially the inside wall and the two flanks are impressed at the sites of the hollow profile rod intended for the corners, thereafter the adhesive sealant is applied to the two flanks of the hollow profile rod, then the corners are bent, and the two ends of the hollow profile rod are connected to each other by a connector, which is inserted in both ends of the hollow profile rod.

37. The method according to claim 36 wherein after impressing the hollow profile rod at the sites intended for the corners, only the flanks are coated with at least one adhesive sealant, wherein at least one of the sealants is a compound containing a desiccant.

38. The method according to claim 36 wherein the corners are only bent after coating the hollow profile rod.

39. The method according to claim 1 wherein a spacer is used which comprises grooves or waves running at a right angle to the glass plates at least on the inside wall thereof, preferably also on the outside wall thereof.

40. The method according to claim 39 wherein the grooves or waves end at a distance in front of the flanks.

41. The method according to claim 21, wherein a sealing compound is provided with a thickness of only 0.25 mm to 0.45 mm, preferably of only 0.3 mm to 0.4 mm, in the central planar partial region of the flanks that is parallel to the insulating glass panes.

42. The method according to claim 41, wherein the insulating glass pane is pressed using a specified specific pressure, for example, of 40 Newton per running centimeter of the circumference of the spacer.

* * * * *